US007484909B2

(12) United States Patent
Brady et al.

(10) Patent No.: US 7,484,909 B2
(45) Date of Patent: Feb. 3, 2009

(54) REINFORCED COMPOSITE MANHOLE COVER ASSEMBLY

(75) Inventors: Robert C. Brady, Muskegon, MI (US); Aidan R. Brady, Muskegon, MI (US)

(73) Assignee: GMI Composites, Inc., Muskegon, MI (US)

( * ) Notice: Subject to any disclaimer, the term of this patent is extended or adjusted under 35 U.S.C. 154(b) by 0 days.

(21) Appl. No.: 11/845,550

(22) Filed: Aug. 27, 2007

(65) Prior Publication Data

US 2008/0050175 A1 Feb. 28, 2008

Related U.S. Application Data

(60) Provisional application No. 60/840,253, filed on Aug. 25, 2006, provisional application No. 60/936,152, filed on Jun. 18, 2007.

(51) Int. Cl.
*E02D 29/14* (2006.01)

(52) U.S. Cl. ..... 404/25; 52/19

(58) Field of Classification Search ..... 404/25, 404/26; 52/19, 20; 49/40
See application file for complete search history.

(56) References Cited

U.S. PATENT DOCUMENTS

| | | | |
|---|---|---|---|
| 166,574 | A | 8/1875 | Willbur |
| D27,673 | S | 9/1897 | Greger |
| D27,674 | S | 9/1897 | Greger |
| D27,676 | S | 9/1897 | Greger |
| D30,812 | S | 5/1899 | Greger |
| D47,686 | S | 8/1915 | Commons |
| 1,859,739 | A | 5/1932 | Keating |
| 1,987,502 | A | 1/1935 | Born et al. |
| 2,188,123 | A | 1/1940 | Swensen et al. |
| 2,877,696 | A | 3/1959 | Elkington |
| D236,790 | S | 9/1975 | Bruno et al. |
| 3,920,347 | A | 11/1975 | Sauriol et al. |
| 4,302,126 | A | 11/1981 | Fier |
| 4,440,407 | A | 4/1984 | Gagas |
| D291,833 | S | 9/1987 | Shore et al. |
| 4,726,707 | A | 2/1988 | Newton |
| 4,763,449 | A | 8/1988 | Vigneron et al. |
| 4,772,154 | A | 9/1988 | Caroulle |

(Continued)

FOREIGN PATENT DOCUMENTS

| | | |
|---|---|---|
| GB | 2308148 | 6/1997 |

(Continued)

OTHER PUBLICATIONS

International Search Report (Form PCT/ISA/210) and Written Opinion of the International Searching Authority (Form PCT/ISA/237) from corresponding Patent Cooperation Treaty Application No. PCT/US07/76888, mailed May 16, 2008.

*Primary Examiner*—Raymond W Addie
(74) *Attorney, Agent, or Firm*—Van Dyke, Gardner, Linn & Burkhart, LLP

(57) ABSTRACT

A lightweight manhole cover assembly includes a cover and a base, with the cover including an inner surface having a plurality of ribs extending therefrom. The base includes an inner surface having a plurality of receptacles extending therefrom. The receptacles of the base have a layout that corresponds to the ribs of the cover, such that the ribs are adapted to be inserted into the receptacles.

29 Claims, 25 Drawing Sheets

U.S. PATENT DOCUMENTS

| | | | | |
|---|---|---|---|---|
| D306,482 | S | 3/1990 | Milo | |
| 4,976,568 | A | 12/1990 | Hess | |
| 5,090,713 | A | 2/1992 | Johnson | |
| 5,130,016 | A | 7/1992 | Gavin | |
| 5,295,535 | A | 3/1994 | Boles et al. | |
| 5,312,202 | A * | 5/1994 | Newton | 404/25 |
| D351,669 | S | 10/1994 | Newton | |
| 5,382,113 | A | 1/1995 | Chilton et al. | |
| 5,513,926 | A | 5/1996 | Prescott | |
| 5,525,006 | A | 6/1996 | Kilman et al. | |
| 5,628,152 | A | 5/1997 | Bowman | |
| 5,788,406 | A | 8/1998 | Hernandez | |
| 6,007,270 | A | 12/1999 | Bowman | |
| D428,658 | S | 7/2000 | Glab et al. | |
| 6,109,822 | A | 8/2000 | Campbell et al. | |
| 6,266,928 | B1 | 7/2001 | Argandona | |
| 6,739,796 | B1 | 5/2004 | Del Nero et al. | |
| 6,763,967 | B2 | 7/2004 | Calder | |
| 6,866,444 | B2 | 3/2005 | Kim | |
| 6,878,281 | B2 | 4/2005 | Graves | |
| 6,887,012 | B1 | 5/2005 | Zappe | |
| 7,144,189 | B1 | 12/2006 | Bongiovanni et al. | |
| 2002/0141820 | A1 | 10/2002 | Hauer et al. | |
| 2002/0176743 | A1 | 11/2002 | Shumlansky et al. | |
| 2003/0007833 | A1 * | 1/2003 | Closkey | 404/25 |
| 2003/0010713 | A1 | 1/2003 | Graves | |
| 2003/0039510 | A1 | 2/2003 | Kuan | |
| 2007/0237580 | A1 * | 10/2007 | Sulak et al. | 404/25 |

FOREIGN PATENT DOCUMENTS

| | | |
|---|---|---|
| JP | 5112957 | 5/1993 |
| JP | 7054367 | 2/1995 |
| WO | 97/22760 | 6/1997 |

* cited by examiner

REINFORCED COMPOSITE MANHOLE COVER ASSEMBLY

CROSS REFERENCE TO RELATED APPLICATIONS

The present application claims the benefit of U.S. provisional applications, Ser. No. 60/840,253, filed Aug. 25, 2006 and Ser. No. 60/936,152, filed Jun. 18, 2007, by Brady et al. for REINFORCED COMPOSITE MANHOLE COVER AND COMPONENTS THEREOF, which are hereby incorporated herein by reference in their entireties.

FIELD OF THE INVENTION

The present invention relates generally to manhole covers.

BACKGROUND OF THE INVENTION

A manhole cover provides a protective covering for an opening into a sewer, a conduit, an underground tunnel or the like. The cover functions to keep trespassers and/or vandals out, to prevent the contents of a sewer or tunnel from exiting the opening, to provide a surface over which vehicles may drive and the like. Manhole covers presently known in the art are generally formed from a heavy steel or metal, which makes them not only difficult to move or transport, but also dangerous, as injuries have occurred in those working with the heavy manhole covers. Moreover, manhole covers formed from steel are not transparent to radio frequency signals. Consequently, wireless meter reading through steel manhole covers is not practical.

SUMMARY OF THE INVENTION

A lightweight manhole cover assembly is provided which is easy to move and transport. According to certain embodiments, a gasket or seal may also be provided to seal a manhole cover assembly over an opening or manhole, and to assist in retaining the pieces of a manhole cover assembly together.

According to an embodiment of the present invention, a manhole cover assembly includes a cover and a base adapted for connecting to the cover. The cover includes an inner surface having a plurality of ribs extending therefrom, and the base includes an inner surface having a plurality of receptacles extending therefrom. The receptacles of the base have a layout that corresponds to the ribs of the cover, such that the ribs are adapted to be inserted into the receptacles.

The ribs and the receptacles may create a distance between the cover and the base. For example, the distance between the cover and the base may be approximately in the range of two to ten inches.

To facilitate and maintain connection between the cover and the base, an adhesive may be included between the ribs and the receptacles. Additionally or alternately, the ribs may be form-fitted into the receptacles.

The manhole cover assembly may be formed from a polymer. Further, the cover and the base may each be formed from different materials.

Optionally, the cover and the base are adapted to include a clamping or latching device for connecting the manhole cover assembly over an opening or manhole. For example, the cover and base may each include an aperture adapted to receive a clamping or latching device. Further, the cover and the base may have at least one corresponding positioning member to align the aperture in the cover with the aperture in the base.

Further, a plurality of receptacles may extend from the inner surface of the cover, and a plurality of ribs may extend from the inner surface of the base. The layout of the ribs and receptacles on the base may be generally the same as the layout of ribs and receptacles on the cover, whereby the cover and the base may be formed from a single mold.

Optionally, the cover may include a treaded outer surface. Both the cover and the base may be formed in any suitable shape, for example, circular or rectangular. The cover may be generally lid-shaped, and the base may be generally bowl-shaped, such that the cover and the base may abut at a periphery of the manhole cover assembly.

According to another embodiment of the invention, a manhole cover assembly includes a cover having an inner surface with a plurality of ribs and a plurality of receptacles extending therefrom, and a base adapted for connecting to said cover. The base also includes an inner surface having a plurality of ribs and a plurality of receptacles extending therefrom, such that the layout of ribs and receptacles on the base is generally the same as the layout of said ribs and said receptacles on the cover. The inner surface of the base is aligned to face the inner surface of the cover, such that the ribs of the cover are adapted to be inserted into the receptacles of the base. Further, the ribs of the base are adapted to be inserted into the receptacles of the cover, such that the cover and the base are retained together.

According to another aspect of the invention, a method of assembling a manhole cover assembly includes providing a cover and a base, each having an inner surface having a plurality of ribs and receptacles extending therefrom. A layout of the ribs and receptacles on the base is generally the same as the layout of the ribs and receptacles on the cover. The method further includes molding the cover and the base from a common mold. The cover and the base are aligned such that the ribs of the cover are adapted to be inserted into the receptacles of the base, and the ribs of the base are adapted to be inserted into the receptacles of the cover. The method includes inserting the ribs of the cover into the receptacles of the base and inserting the ribs of the base into the receptacles of the cover to retain the base and the cover together.

The method may also include applying an adhesive between the ribs and the receptacles to retain the ribs in the receptacles, and/or form-fitting the ribs into the receptacles.

Aligning the cover and base may include rotating the base and cover to align an end of the cover with an opposite end of the base.

A plurality of apertures may be provided or formed in the cover and base, the apertures being positioned about the ribs and the receptacles. Further, the method may include machining at least a portion of the base to provide at least one opening between or around or about the ribs and receptacles in the base.

According to another aspect of the invention, a protective gasket for a manhole cover comprises a seal formed from an elastomeric material and adapted to be positioned between the manhole cover and an opening covered by the manhole cover. The gasket is adapted to assist in retaining at least two portions or pieces of a manhole cover assembly together.

A cross section of the gasket may be C-shaped or L-shaped. Optionally, the gasket may include a first portion adapted to be positioned between an outer edge of the manhole cover and the opening covered by the manhole cover. Another portion may be positioned between a bottom edge of the manhole cover and the opening.

Further, the gasket may create a sealed connection between the manhole cover or manhole cover assembly and the opening. The gasket may be used with a unitary manhole cover or a manhole cover assembly having at least two components. Optionally, the elastomeric material used to form the seal may be an EPDM elastomer.

These and other objects, advantages, purposes and features of the present invention will become apparent upon review of the following specification in conjunction with the drawings.

DESCRIPTION OF THE PREFERRED EMBODIMENTS

Figure 1:
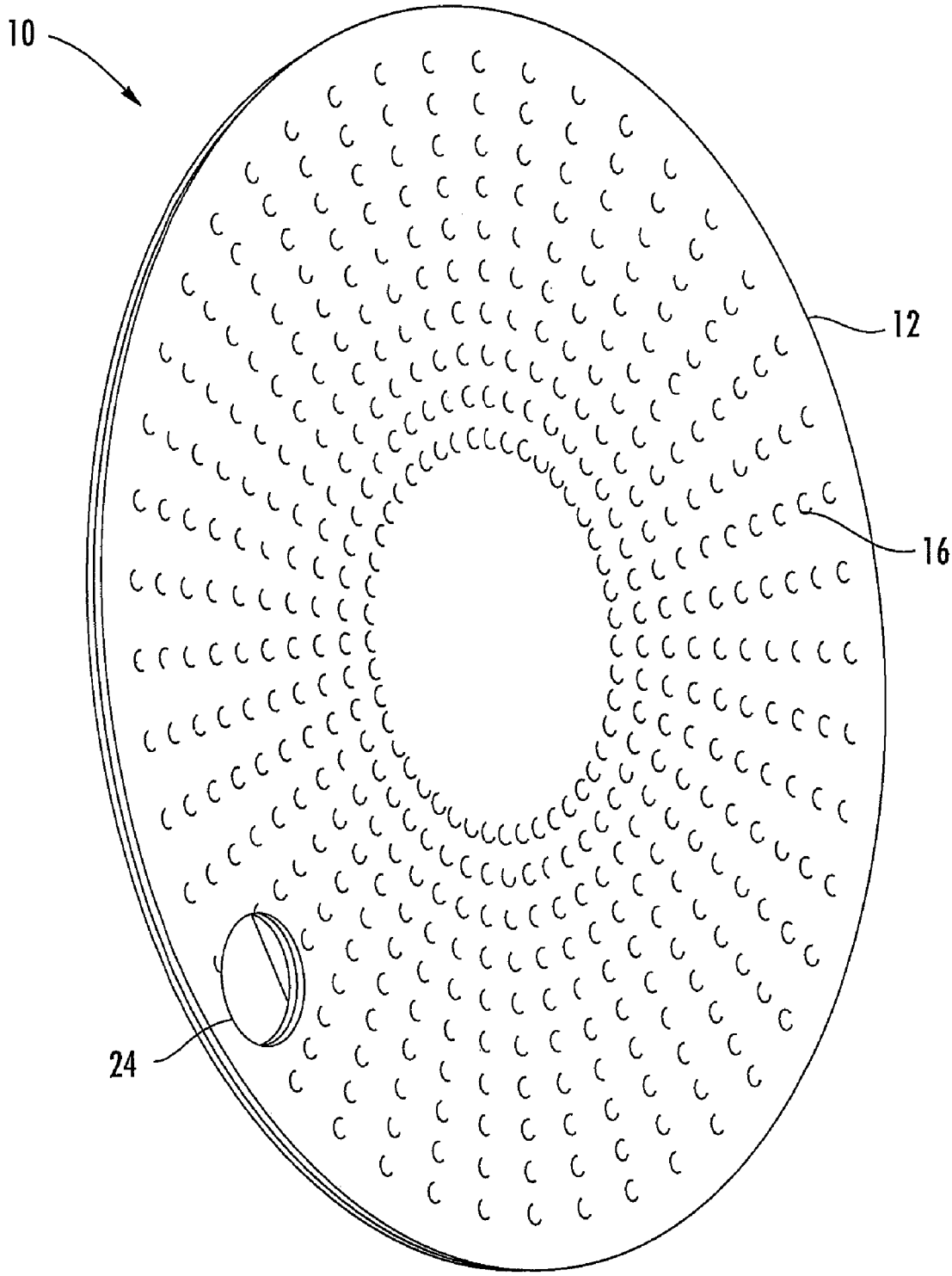
FIG. 1 is a perspective view of an outer surface of a cover of a manhole cover assembly according to an aspect of the present invention, taken from the top and side.
Figure 2:
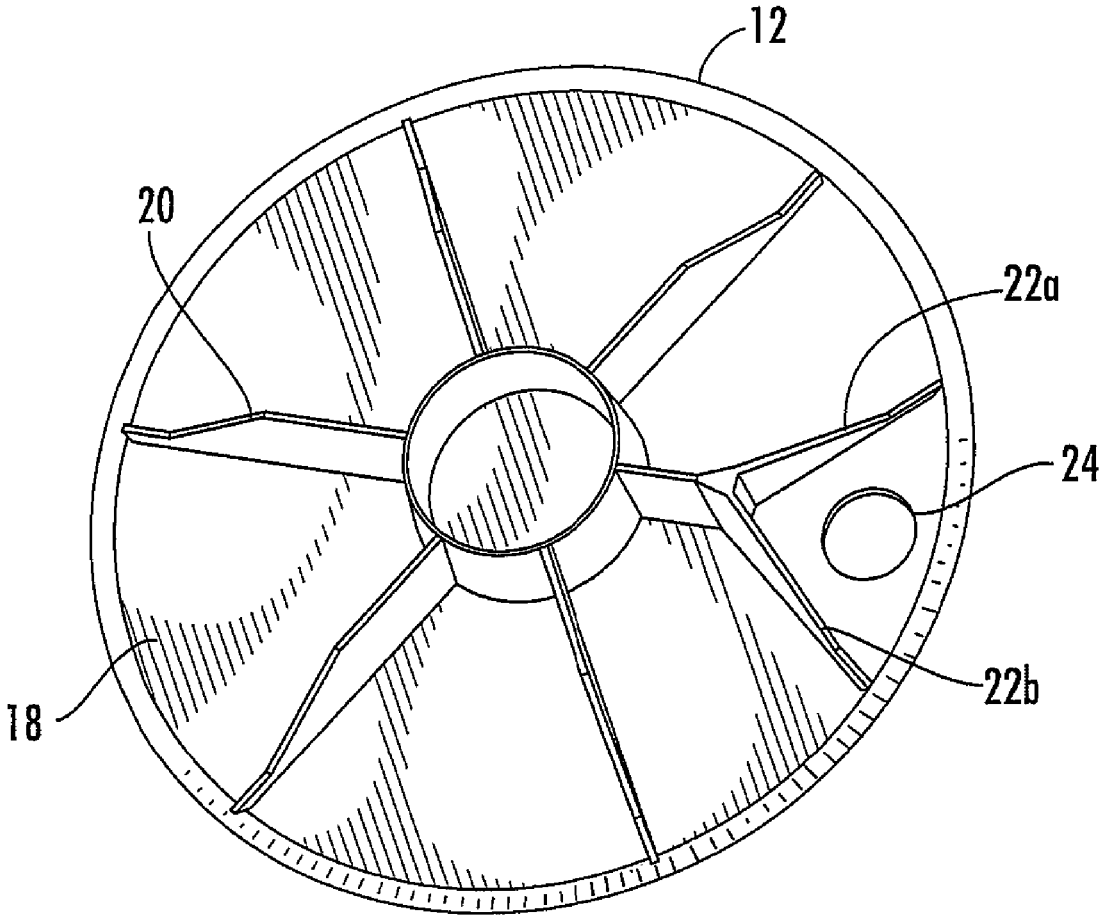
FIG. 2 is a perspective view of an inner surface of the cover of FIG. 1.
Figure 3:
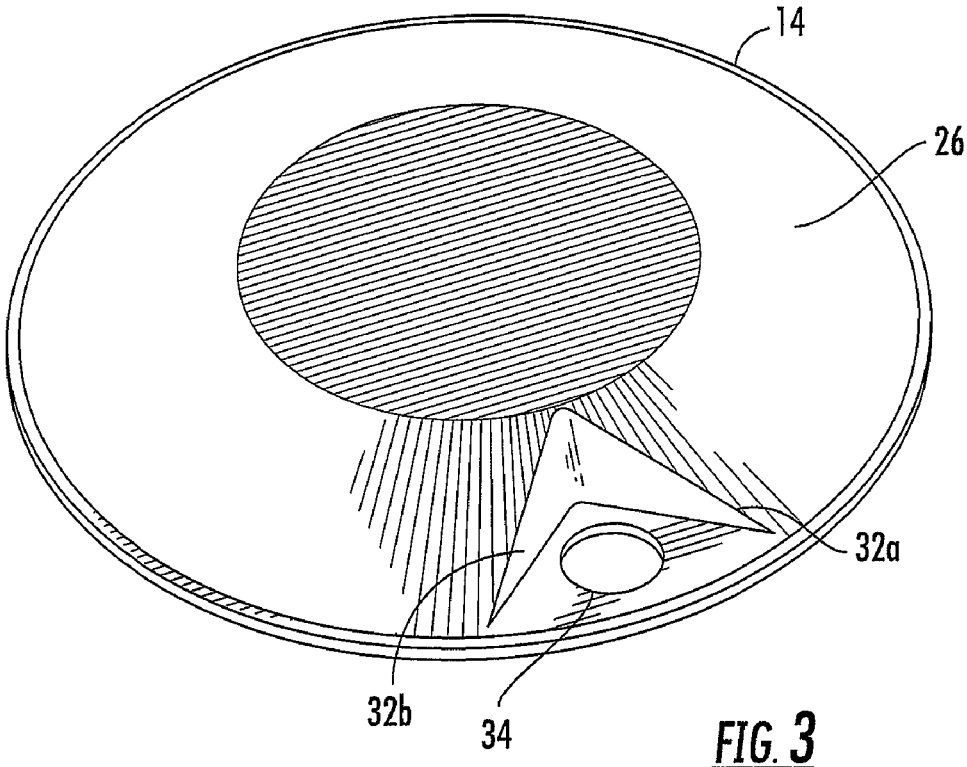
FIG. 3 is a perspective view of an outer surface of a base of the manhole cover assembly of FIG. 1.
Figure 4:
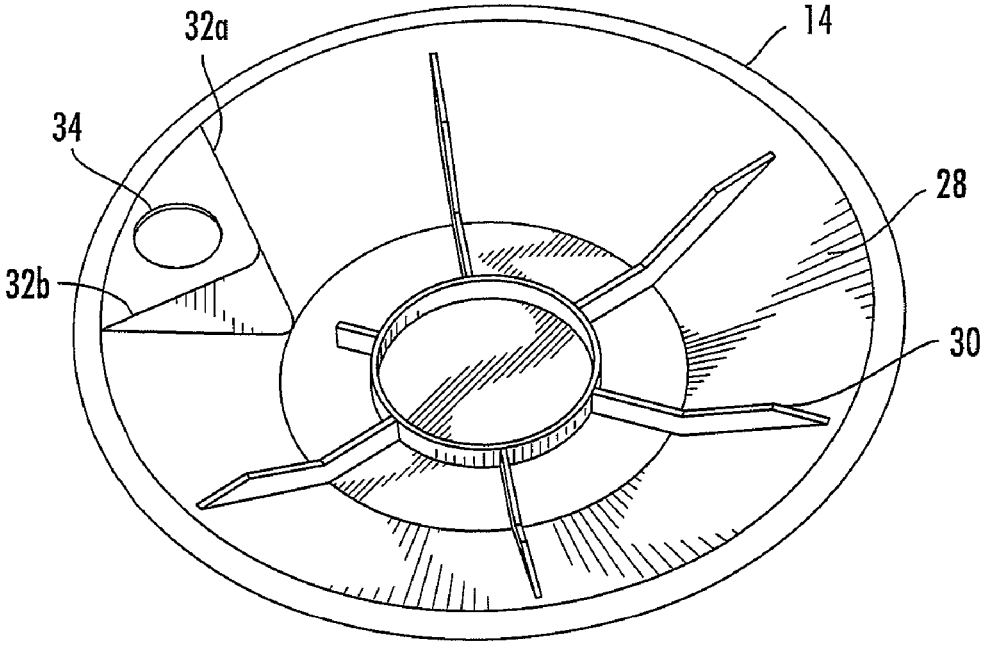
FIG. 4 is a perspective view of an inner surface of the base of FIG. 3.
Figure 5:
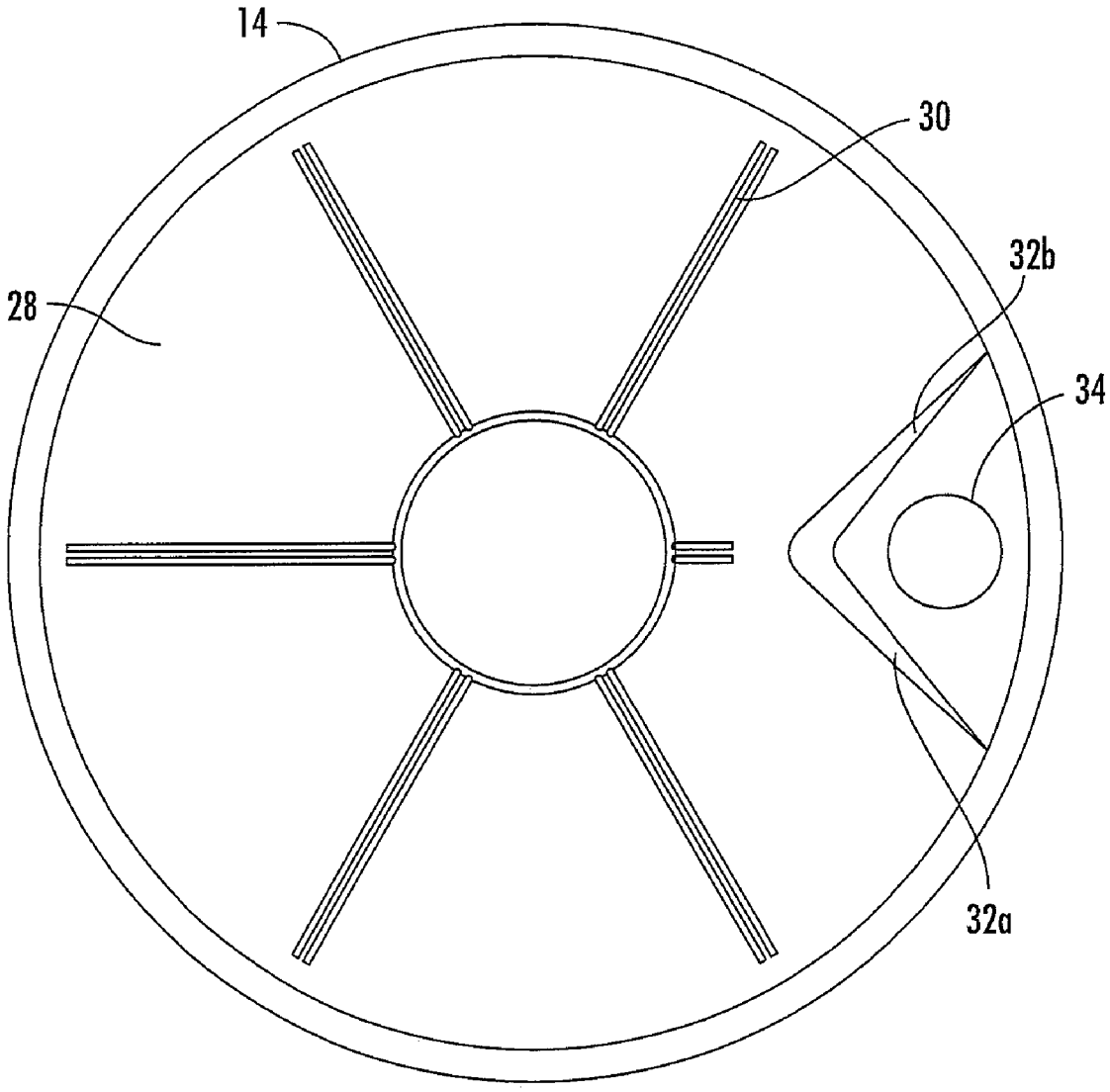
FIG. 5 is a top plan view of the base of FIGS. 3 and 4.
Figure 6:
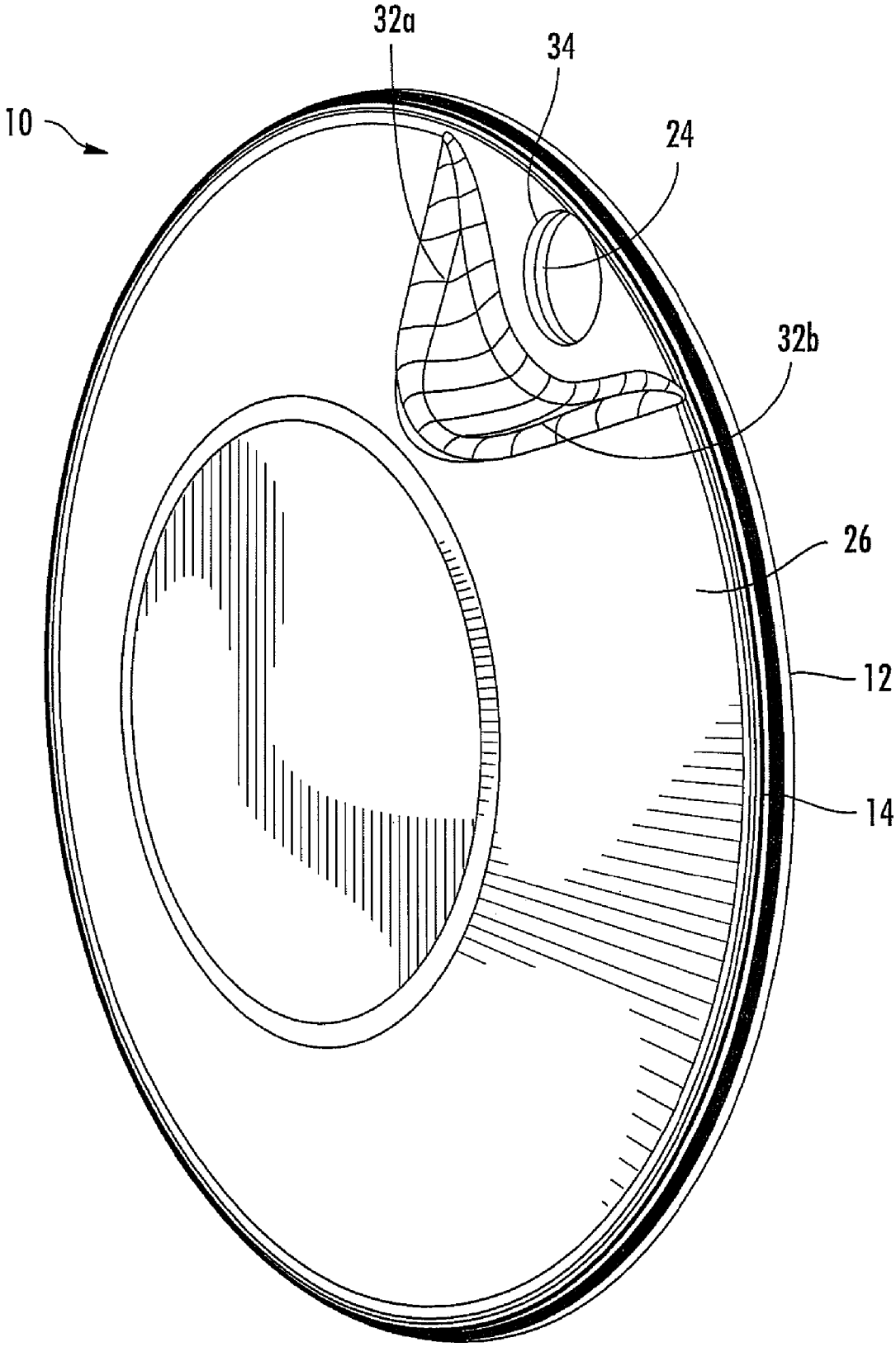
FIG. 6 is a perspective view of the manhole cover assembly of FIG. 1, taken from the bottom and side.
Figure 7:
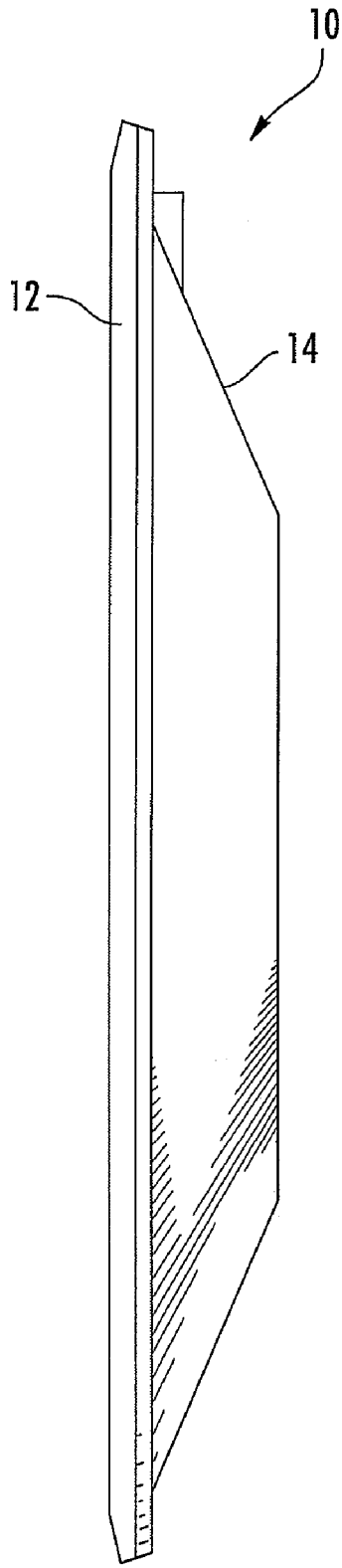
FIG. 7 is a side elevation of the manhole cover assembly of FIG. 1.
Figure 8:
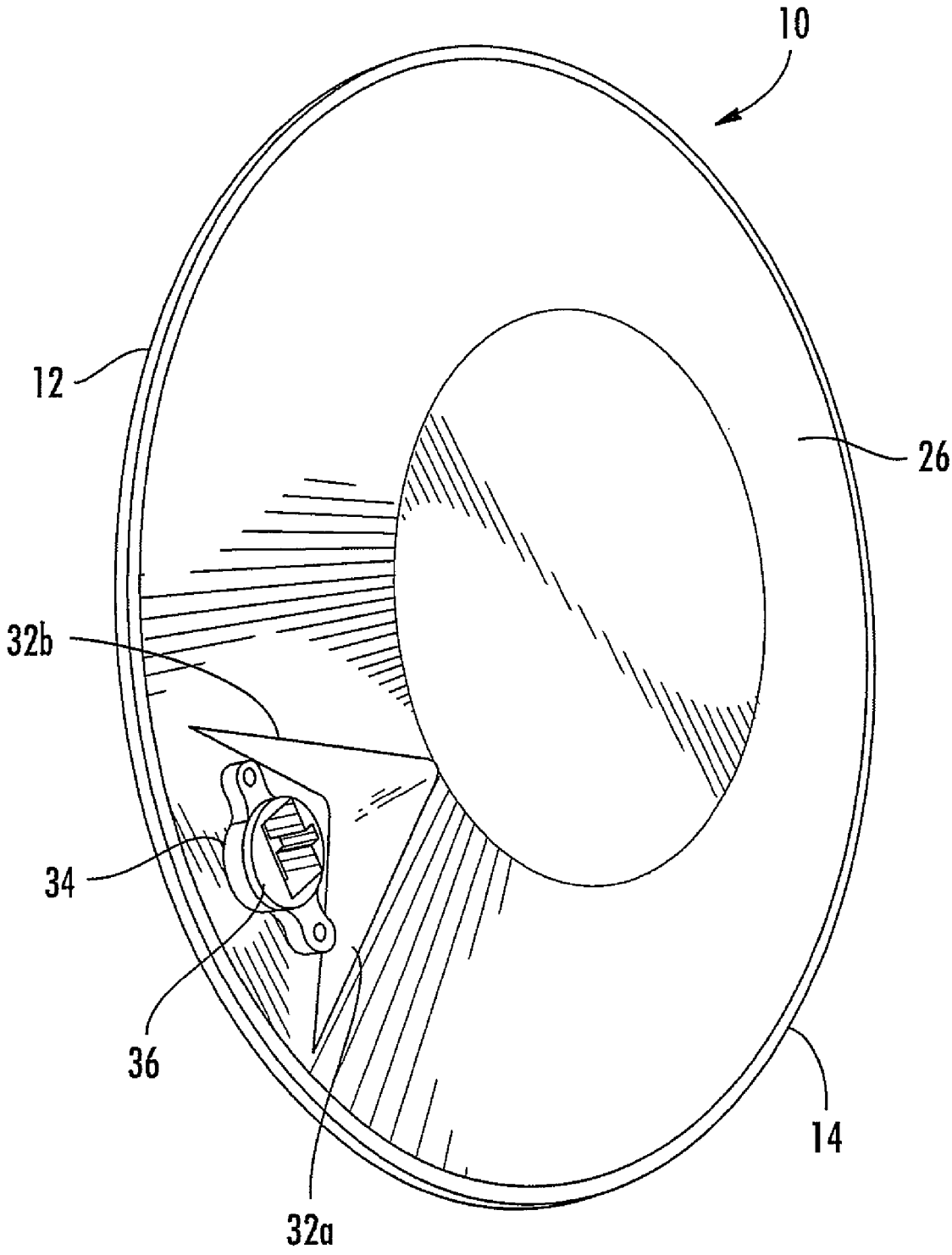
FIG. 8 is a perspective view of the manhole cover assembly of FIG. 1 for use with a locking mechanism.

Referring now to the drawings and the embodiments illustrated therein, a manhole cover assembly 10 includes a cover 12 and a base 14 adapted for connecting to cover 12. Cover 12 includes an inner surface 18 having a plurality of ribs 20 extending therefrom (FIG. 2). As shown in FIGS. 3 and 4, base 14 includes an outer surface 26 and an inner surface 28 having a plurality of receptacles 30 extending therefrom. The layout of receptacles 30 on base 14 corresponds with that of ribs 20 on cover 12, such that ribs 20 may be inserted into receptacles 30 to join cover 12 and base 14 to form manhole cover assembly 10 (FIGS. 6 and 7). Optionally, cover 12 and base 14 may be generally circular (FIGS. 1-5) or may be generally square or rectangular. (For example, see manhole cover assembly 110 of FIG. 9 and manhole cover assembly 500 of FIG. 12, which will be discussed in more detail below).

Ribs 20 of cover 12 and receptacles 30 of base 14 may be configured in any pattern that allows the ribs to be inserted into the receptacles. In the illustrated embodiment, ribs 20 and receptacles 30 are arranged in a circular pattern at or near the center of cover 12 and base 14, respectively, with the ribs and receptacles extending outward from the circular pattern toward the periphery of cover 12 and base 14.

Additionally, ribs 20 and receptacles 30 are formed to create a distance between cover 12 and base 14 to impart structural strength, similar to a truss, for example. For example, the distance between cover 12 and base 14 may be approximately in the range of two to ten inches. Ribs 20 and receptacles 30 may also be formed to allow cover 12 and base 14 to be joined at a periphery of the manhole cover assembly. In the illustrated embodiment, cover 12 is generally flat or lid-shaped, while base 14 is bowl-shaped or concave (FIGS. 1-4). In such as configuration, a distance between cover 12 and base 14 is maintained even when the cover and base are joined at the periphery (FIGS. 6 and 7).

Optionally, the cover and the base may be formed to accommodate a locking or clamping device or the like. For example, cover 12 and base 14 may include apertures 24, 34, respectively, which become aligned when cover 12 and base 14 are joined to form manhole cover assembly 10 (FIGS. 1-4). Aligned apertures 24, 34 are adapted to receive any standard locking or latching or clamping or sealing device or mechanism, such as those disclosed in U.S. patent application Ser. No. 11/845,549, filed concurrently herewith by Brady, et al., for a CLAMPING ASSEMBLY FOR A MANHOLE COVER the disclosure of which is hereby incorporated herein by reference in its entirety.

The manhole cover assembly may include a feature to assist in aligning the cover and the base for proper insertion of the ribs into the receptacles. For example, at least one of the cover and the base may include aligning or positioning members or surfaces. In the illustrated embodiment, to facilitate proper insertion of ribs 20 into receptacles 22, and proper alignment of apertures 24 and 34, base 14 includes positioning members or surfaces 32*a*, 32*b*, which are formed as indentations or grooves in outer surface of base 14. The indentations 32*a*, 32*b* of base 14 form a protrusion or projection at inner surface 28 of base 14. Cover 12 includes corresponding positioning members 22*a*, 22*b*, which are formed as projections from the inner surface 18 of cover 12, which form a pocket or compartment at inner surface 18 of cover 12 (FIG. 2). The projection formed by positioning members 32*a*, 32*b* of base 14 is adapted to easily fit or nest within the pocket formed by positioning members 22*a*, 22*b* of cover 12. When alignment of positioning members 22*a*, 22*b* and 32*a*, 32*b* is achieved, ribs 20 are aligned with and may be easily inserted into receptacles 30 to form manhole cover assembly 10. In addition to facilitating the alignment of cover 12 and base 14, positioning members 22*a*, 22*b* and 32*a*, 32*b* may prevent cover 12 and base 14 from being joined in any other configuration.

To facilitate and/or maintain the connection of cover 12 and base 14, an adhesive may be included in or on receptacles 30 or may be applied directly to ribs 20. The adhesive may be a hard system of adhesive adapted to create a firm or fixed connection between cover 12 and base 14, or the adhesive may be a rubberized system of adhesive adapted to allow cover 12 and base 14 to flex or bend, while maintaining a firm connection between cover 12 and base 14. Optionally, the adhesive may include or contain methyl methacrylate (MMA). Adhesive for the manhole cover assembly may be supplied by Elsworth Adhesive Systems, which has a place of business at 317 S Maria Ave, Redondo Beach, Calif. 90277-3541, or may alternately be supplied by ITW Plexus, having a place of business at 30 Endicott Street, Danvers, Mass., 01923. Alternately, or in addition to the adhesive connection, ribs 20 may be form-fitted or press-fitted into receptacles 30.

Manhole cover assembly 10 may be formed from any suitable material and method of manufacturing. In the illustrated embodiments, manhole cover assembly 10 is manufactured by injection molding and is formed from a polymer or resin, which one skilled in the art would know may include nylon, urethane, polyester, epoxy, phenolic and the like. Polymers are generally lightweight, as opposed to steel, which is typically used to form manhole covers. Such polymers may also be glass or fiber reinforced, which creates strength while maintaining the relatively light weight of the material. Fibers used to reinforce the resin include fiberglass, carbon fiber, and aramid, which is sold under the trade name Kevlar. The percentage of resin and fiber reinforcing material used in production of the manhole cover assemblies varies based on the strength requirements of the manhole cover assemblies. Thus, manhole cover assembly 10 may be easier and safer to transport and work with than known steel manhole covers. Also, because polymers are generally transparent to radio frequency signals, wireless meter reading through manhole cover assembly 10 is possible, which eliminates the need to remove the manhole cover in order to perform such meter reading.

In addition, cover 12 and base 14 of manhole cover assembly 10 may each be formed from different materials. Cover 12 is adapted to face outside of the opening or manhole, while base 14 is adapted to face inside the opening or manhole. Thus, for example, base 14 may require a material with certain properties based on the environment within the opening being covered by manhole cover assembly 10 or based on the contents of the opening. However, cover 12 may not require the same material properties as base 14, or cover 12 may require a different material based on the environment outside of the opening and based on whether vehicles will be driving over cover 12. Thus, cover 12 and base 14 may be formed from different materials, but may nonetheless be joined as discussed above to form manhole cover assembly 10.

Figure 10:
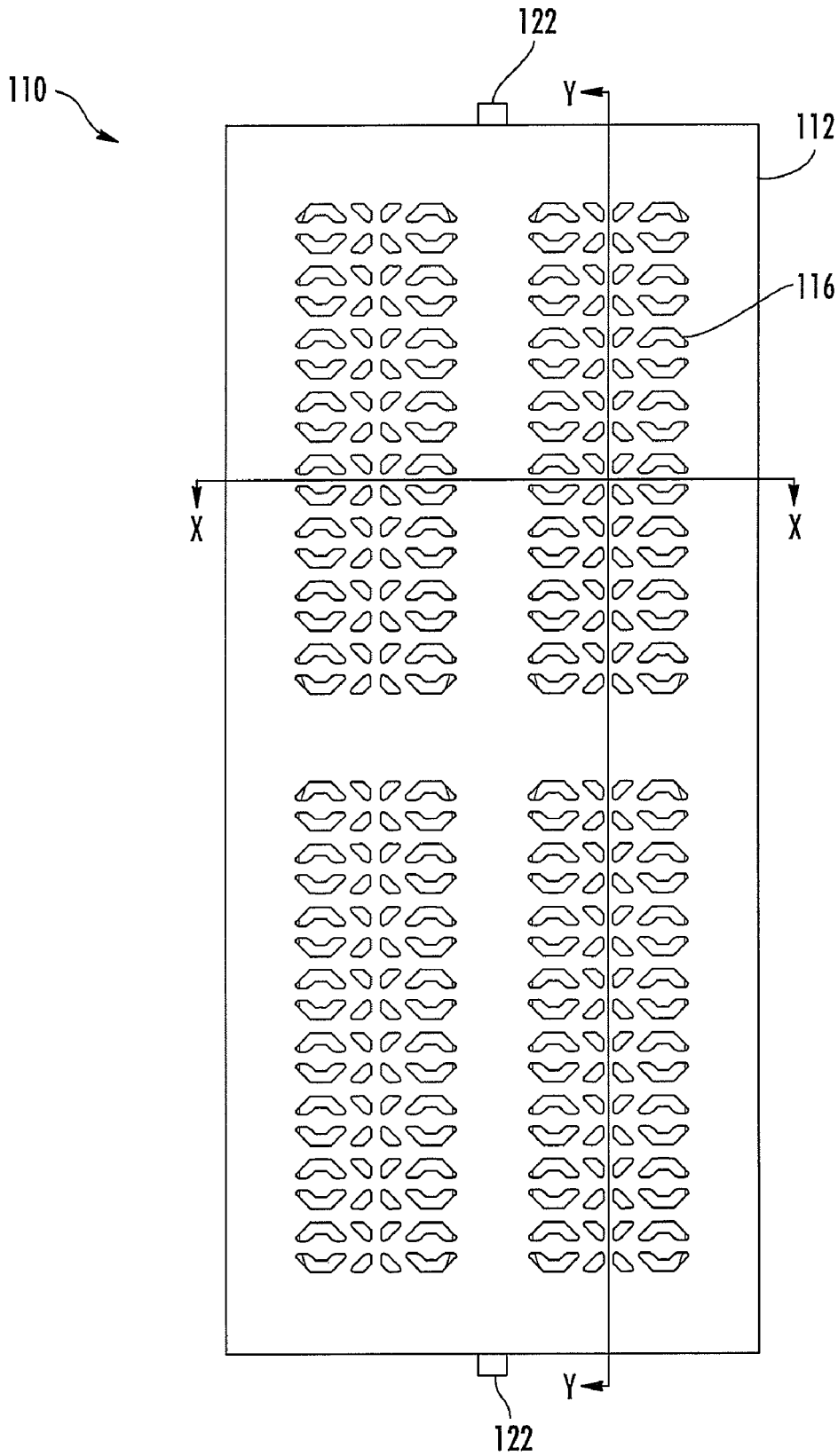
FIG. 10 is a top plan view of another manhole cover assembly according to the present invention.
Figure 11:
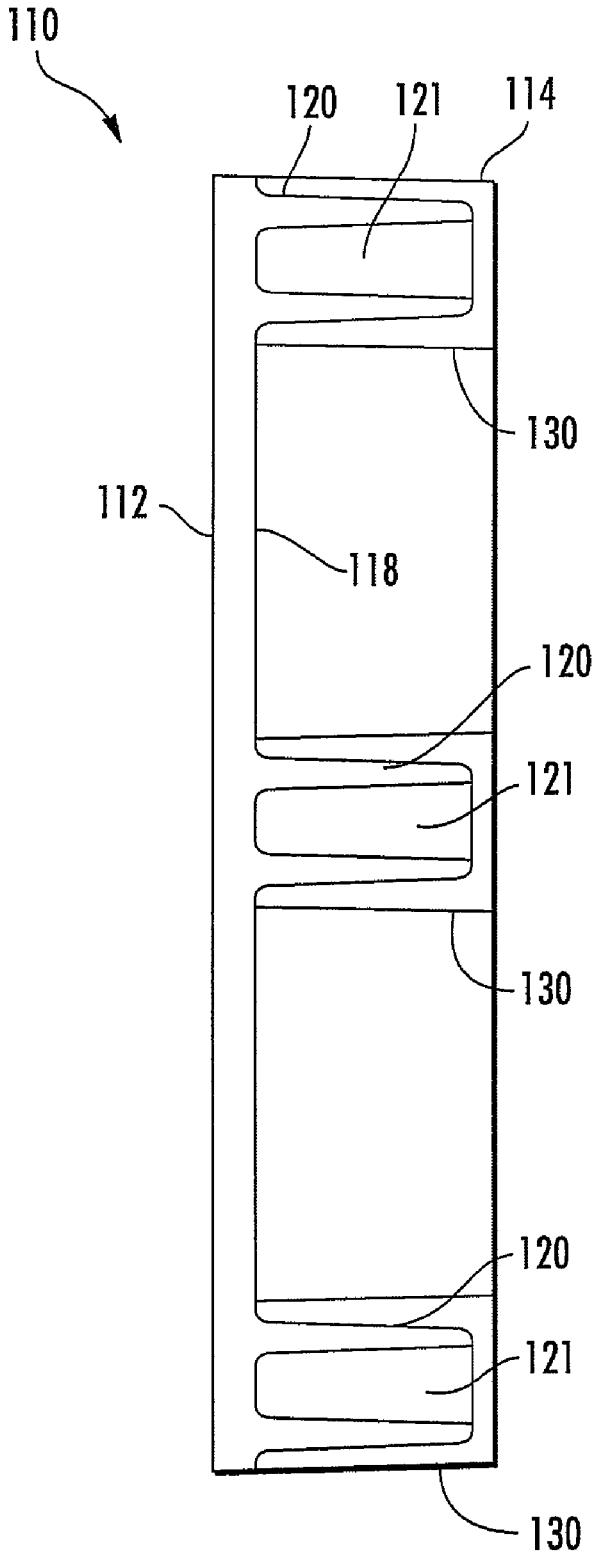
FIG. 11 is a sectional view taken along the line X-X in FIG. 10.
Figure 12:
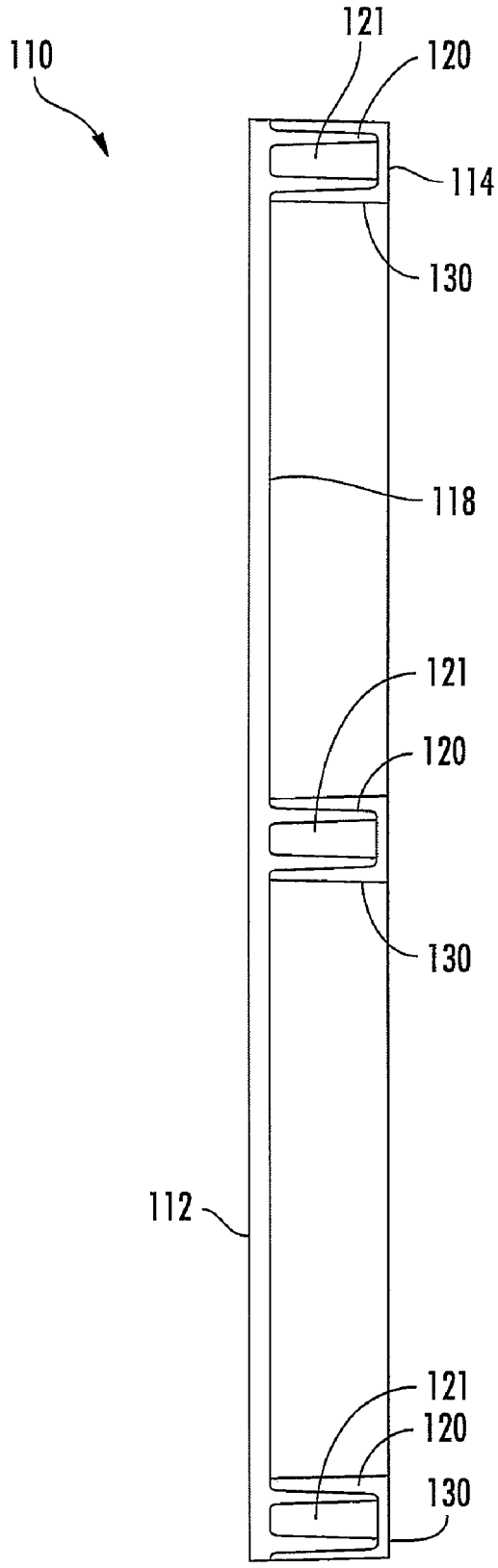
FIG. 12 is a sectional side elevation taken along the line Y-Y in FIG. 10.
Figure 13:
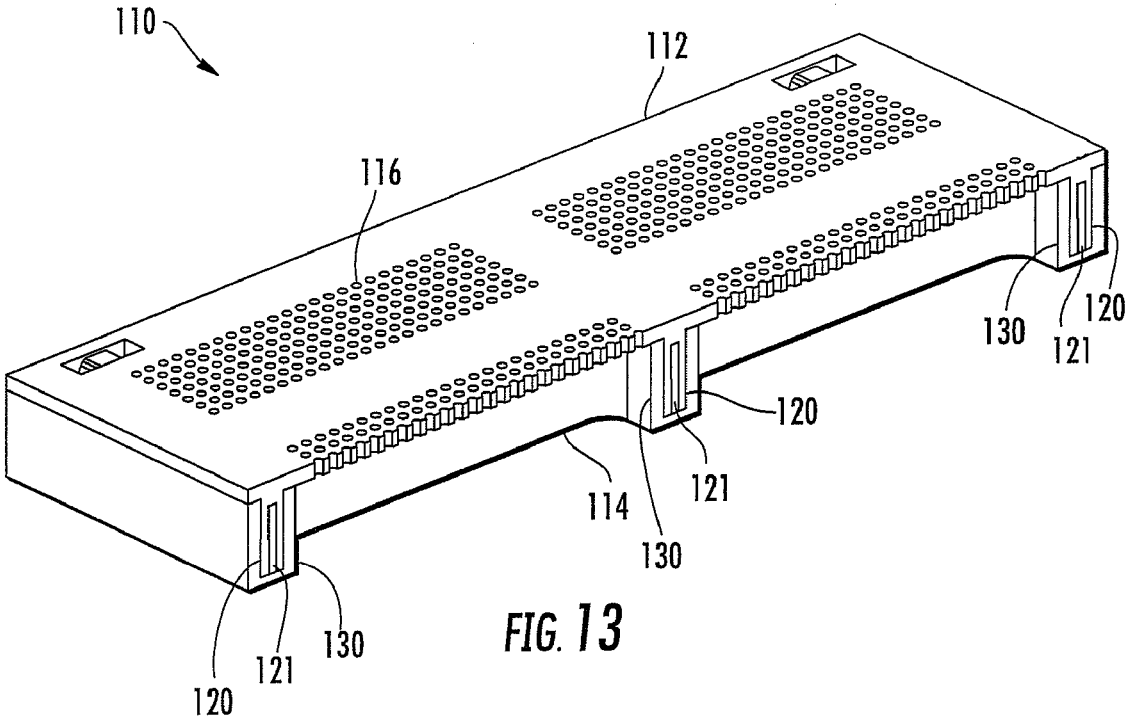
FIG. 13 is a perspective sectional view of the manhole cover assembly of FIG. 9.

Optionally, a manhole cover assembly may include a cover having pairs of ribs 120 extending therefrom. In the illustrated embodiments of FIGS. 9-14, manhole cover assembly 110 includes a cover 112 having an inner surface 118 having a plurality of ribs 120 extending therefrom, the ribs being positioned in pairs, such that two ribs 120 are sized and adapted to be inserted or press-fitted into a receptacle 130 of base 114. Thus, pairs of ribs 120 function in the same manner as ribs 20, discussed above. However, when pairs of ribs 120 of cover 112 are inserted into receptacles 130 of base 114, a hollow space 121 remains at the center of receptacles 120, as opposed to having a solid rib inserted into the receptacle (FIGS. 11-13).

Further, cover 112 and base 114 are generally rectangular in shape and include ribs and receptacles that extend in generally parallel and perpendicular rows. In the illustrated embodiment, cover 112 and base 114 each include three rows of parallel pairs of ribs 120 and receptacles 130, respectively, and three rows of perpendicular pairs of ribs 120 and receptacles 130, respectively (FIGS. 10 and 11). Optionally, alignment lugs 122 may be included and may extend out from an edge of cover 112 and base 114 to facilitate placement of manhole cover assembly 110 over a manhole or opening or in a frame positioned at a manhole or an opening (FIG. 10).

Figure 9:
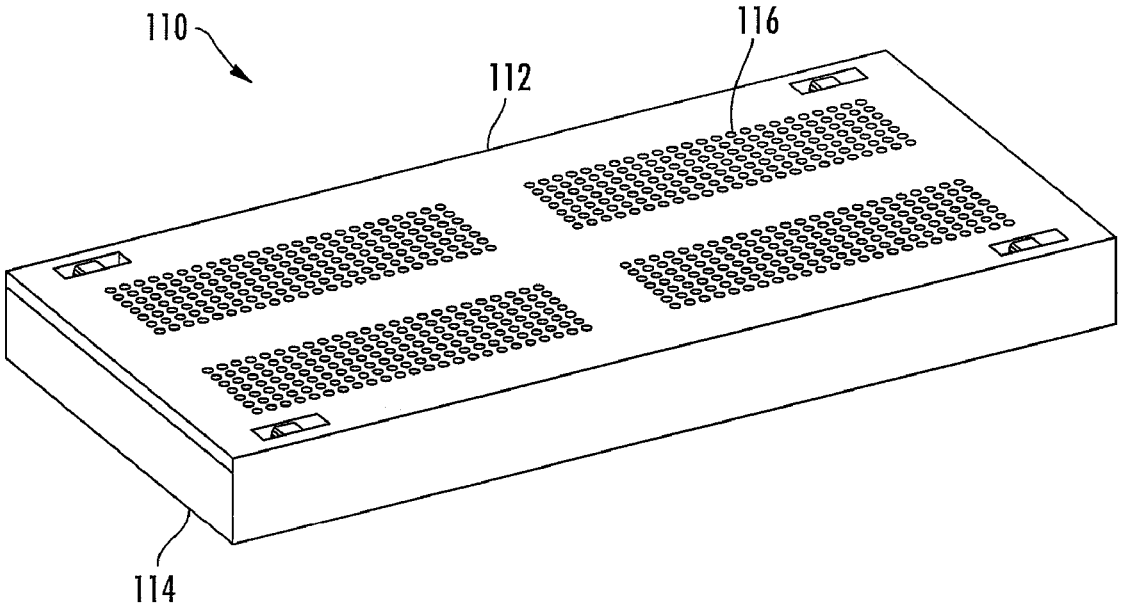
FIG. 9 is a perspective view of another manhole cover assembly according to the present invention.
Figure 14:
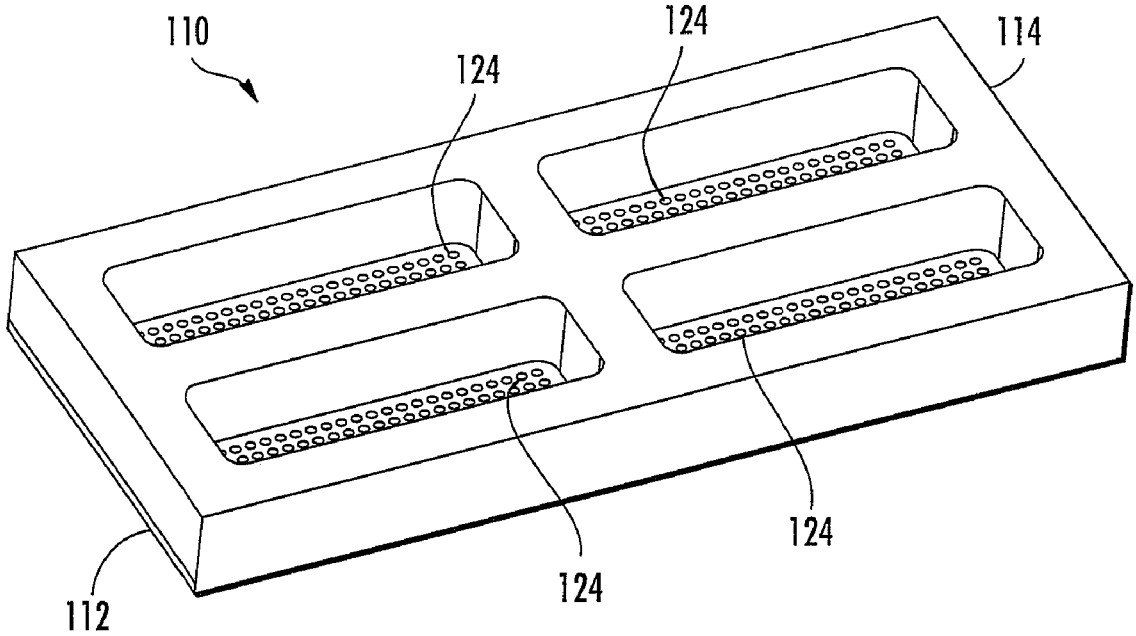
FIG. 14 is a perspective view of the manhole cover assembly of FIG. 9, taken from the bottom.

Optionally, manhole cover assembly 110 may be ventilated. For example, cover 112 or base 114 may include apertures or openings. In the illustrated embodiment, cover 112 includes a plurality of apertures 116 therethrough. The apertures may be formed as circular apertures, as shown in FIGS. 9, 13 and 14, or may be formed in any suitable or desirable shape or configuration, such as that illustrated in FIG. 10, for example. Further, base 114 includes openings or open areas or gaps 124 around or between receptacles 130, through which access to cover 112 may be achieved (FIG. 14). Base 114 may be formed or molded to include openings 124, or base 114 may be formed having a solid surface, with material being selectively removed or milled out to ventilate base 114 as desired. Manhole cover assembly 110 may otherwise be substantially similar to manhole cover assembly 10, such that another detailed description is not required.

Figure 15:
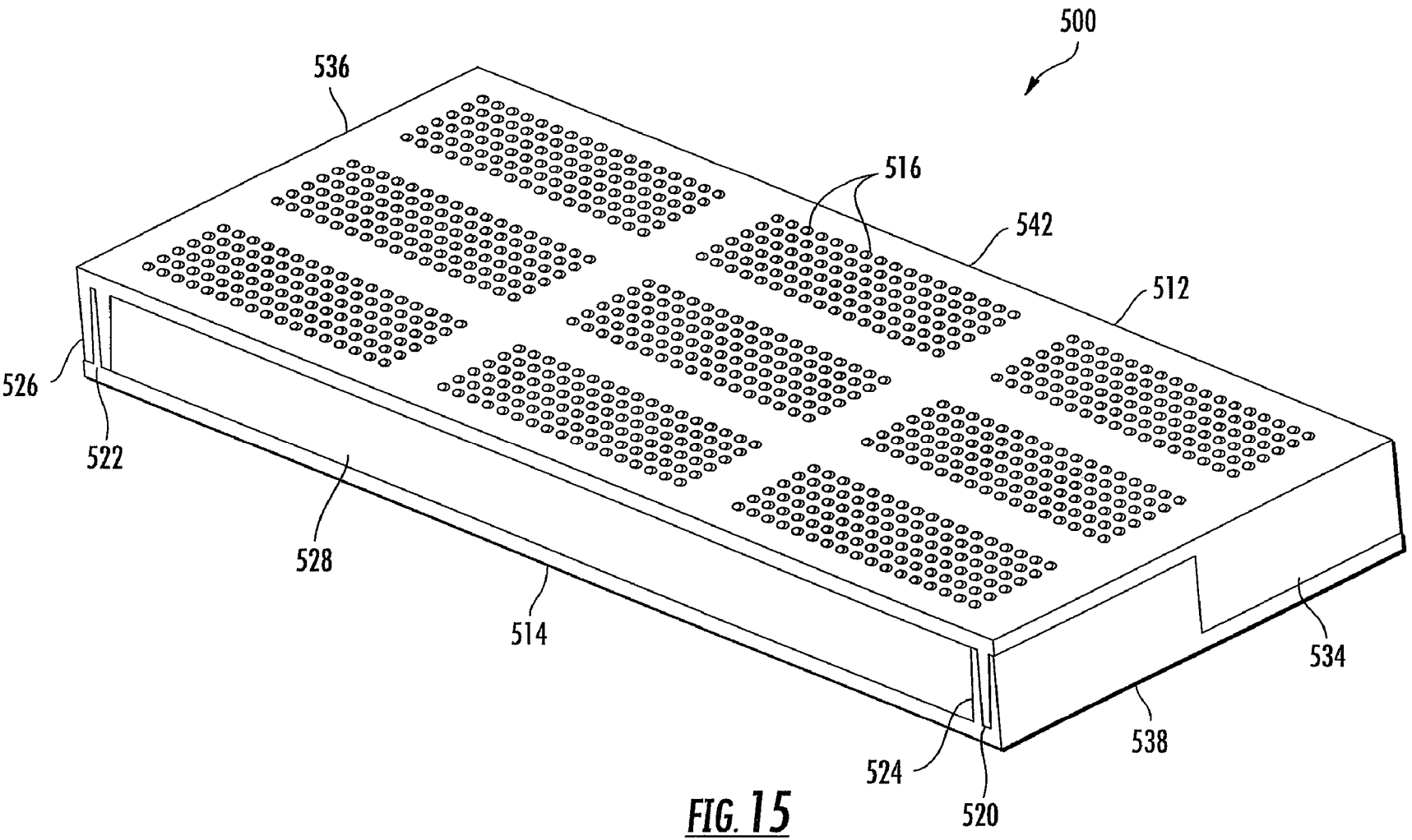
FIG. 15 is an upper perspective view of another manhole cover assembly according to the present invention.
Figure 16:
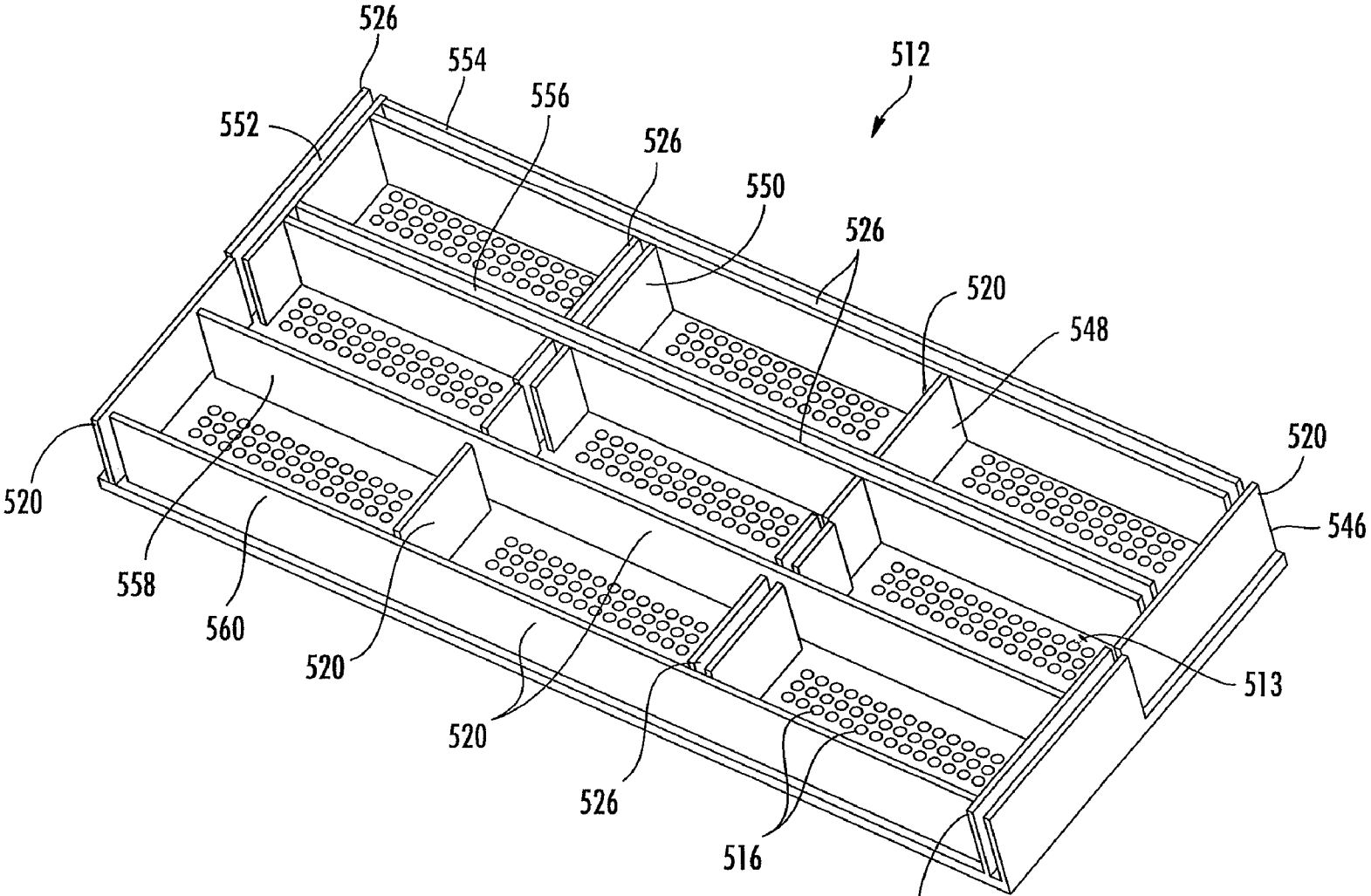
FIG. 16 is a perspective view of a cover of the manhole cover assembly of FIG. 15.
Figure 17:
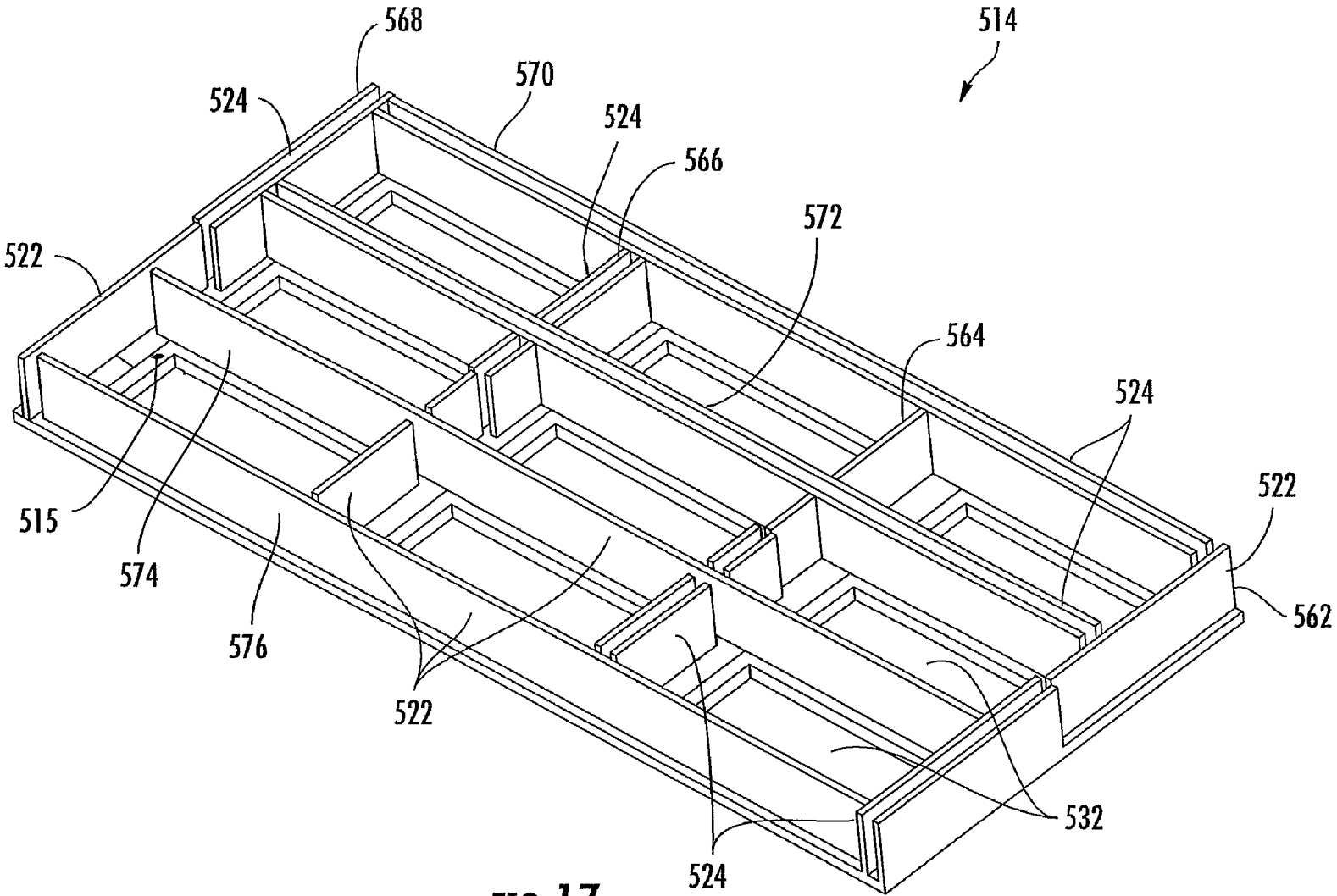
FIG. 17 is a perspective view of a base of the manhole cover assembly of FIG. 15.

According to another embodiment of the invention, a manhole cover assembly 500 includes a cover 512 and a base 514, which are adapted to be connected together (FIG. 15). Cover 512 includes an inner surface 513 having a plurality of ribs 520 and a plurality of receptacles 526 extending therefrom (FIG. 16). Base 514 includes an inner surface 515 having a plurality of ribs 522 and a plurality of receptacles 524 extending therefrom (FIG. 17). The layout of ribs 522 and receptacles 524 on base 514 generally correspond to and may be identical to the layout of ribs 520 and receptacles 526 on cover 512. The respective inner surfaces 513, 515 of cover 512 and base 514 are aligned to face each other, such that the ribs 520 of cover 512 may be inserted into the receptacles 524 of base 514, and the ribs 522 of base 514 are inserted into the receptacles 526 of cover 512.

In the illustrated embodiment, cover 512 and base 514 are generally rectangular in shape. The ribs and receptacles of both cover 512 and base 514 are arranged in parallel rows and parallel columns, with the rows being perpendicular to the columns. Rows of ribs and receptacles are positioned along the lengthwise axis of cover 512 and base 514, while columns of ribs and receptacles are positioned along the axis of width of cover 512 and base 514. The rows and columns of ribs and receptacles create a grid-like pattern on both cover 512 and base 514.

As best shown in FIG. 16, cover 512 may include two adjacent rows of receptacles 554, 556 on one side or half of cover 512, and two adjacent rows of ribs 558, 560 on an opposite side or half of cover 512. The receptacle of row 554 and the rib of row 560 form two of the outer walls of cover 512.

In the illustrated embodiment, cover 512 further includes four columns, each of which at least partially includes a rib and at least partially includes a receptacle. For example, columns 546 and 548 each include a rib portion that intersects or adjoins or abuts the receptacles of rows 554, 556, and a receptacle portion that intersects with the ribs of rows 558, 560. Columns 550 and 552 each include a receptacle portion that intersects or adjoins or abuts the receptacles of rows 554, 556, and a rib portion that intersects with the ribs of rows 558, 560.

Similarly, base 514 may include two adjacent rows of receptacles 570, 572 on one side or half of base 514, and two adjacent rows of ribs 574, 576 on an opposite side or half of cover 512 (FIG. 17). Row 570, which includes a receptacle, and row 576, which includes a rib, form two of the outer walls of base 514.

Base 514 may further include four columns, each of which at least partially includes a rib and at least partially includes a receptacle. For example, columns 562 and 564 each include a rib portion that intersects or adjoins or abuts with the receptacles of rows 570, 572, and a receptacle portion that intersects or adjoins or abuts the ribs of rows 572, 574. Columns 566 and 568 may each include a receptacle portion that intersects or adjoins or abuts the receptacles of rows 570, 572, and a rib portion that intersects or adjoins or abuts the ribs of rows 574, 576. Columns 562, 568 form two of the outer walls of base 514.

Figure 18:
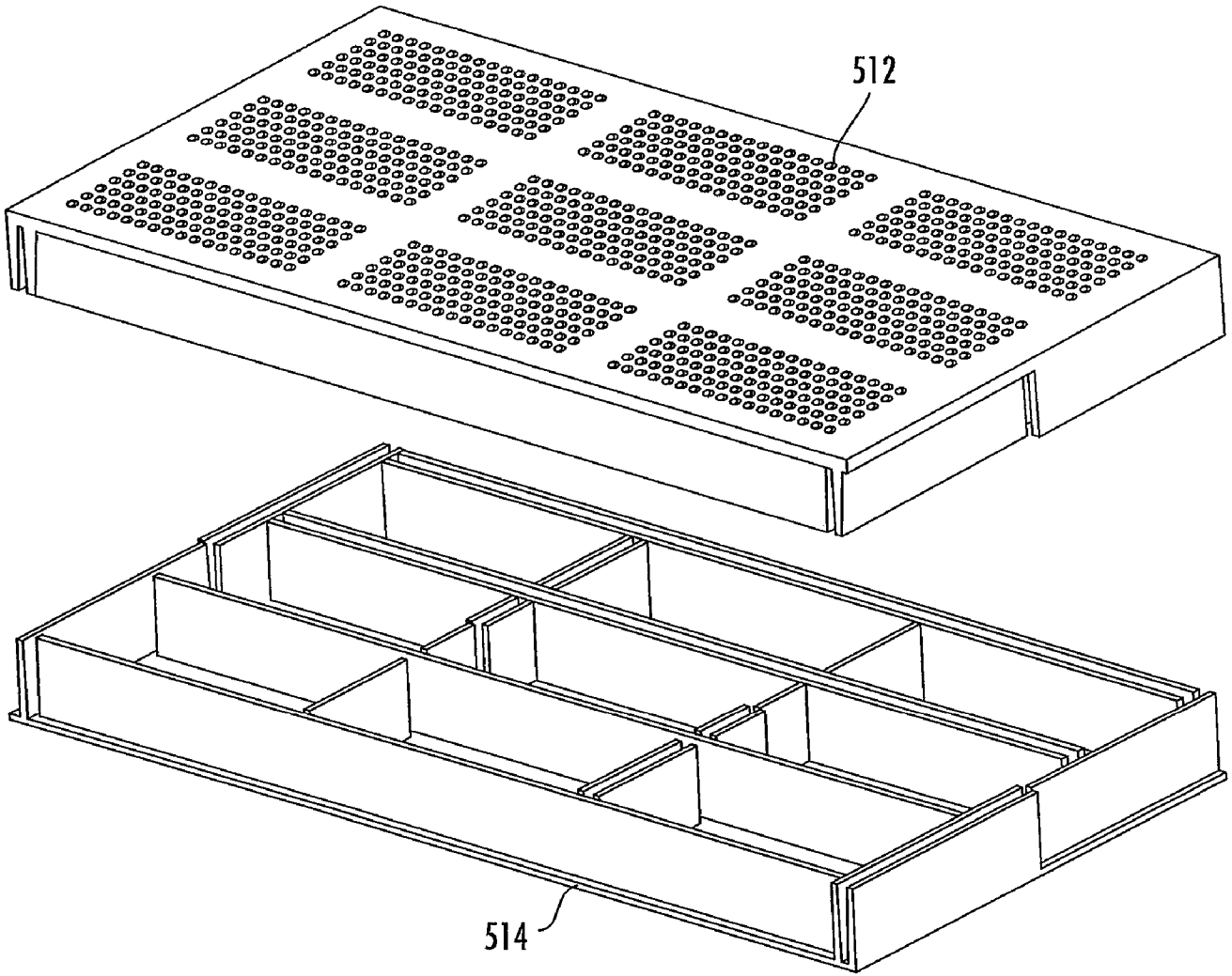
FIG. 18 is a perspective view of the manhole cover assembly of FIG. 15, with the cover separated from the base.

To achieve alignment and assembly of cover 512 and base 514, the respective inner surfaces 513, 515 of cover 512 and base 514 are positioned to face each other, such that receptacles 526 of cover 512 are aligned to receive ribs 522 of base 514, and receptacles 524 of base 514 are aligned to receive ribs 520 of cover 512 (FIG. 18). Such an alignment results in a configuration in which the receptacles of rows 570, 572 of base 514 are aligned to receive the ribs of rows 558, 560 of cover 512. Further, columns 546, 548, 550, 552 of cover 512 align with columns 562, 564, 566, 568 of base 514, such that the rib and receptacle portions of the respective columns of cover 512 align with the respective or corresponding receptacle and rib portions of base 514.

Because cover 512 and base 514 include a layout or arrangement of ribs and receptacles that is generally the same, cover 512 and base 514 may be formed as generally the same part. Accordingly, cover 512 and base 514 may be formed using the same mold, for example, the same injection mold. A base 514 that has been formed from the same mold as cover 512 is adapted to be rotated with respect to cover 512 (or cover 512 may be rotated with respect to base 514), such that an end of base 514 is oriented to be aligned with an opposite end of cover 512. In such a configuration, the receptacles of rows 554, 556 of cover 512 are aligned to receive the ribs of rows 574, 576 of base 514.

Figure 19:
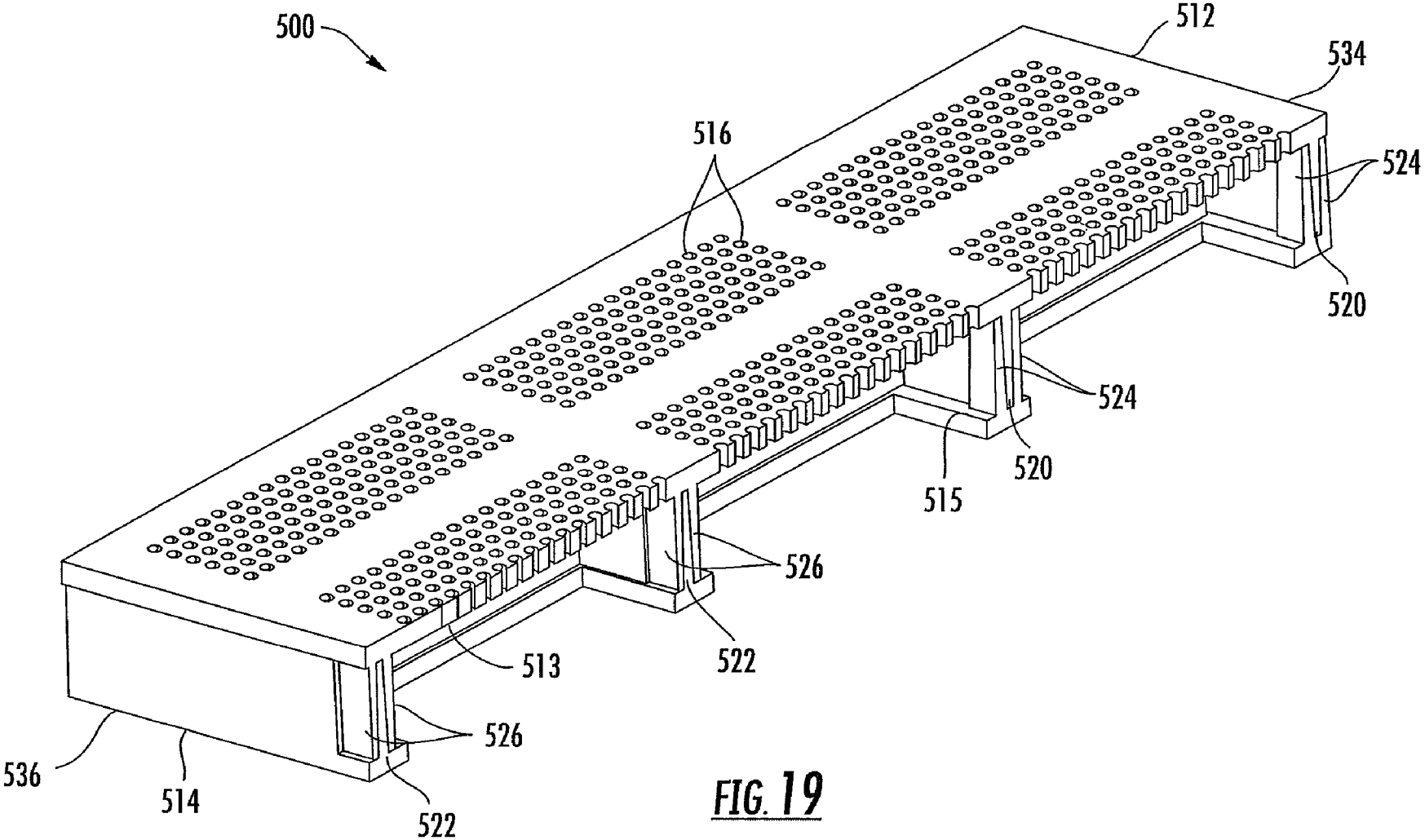
FIG. 19 is a perspective sectional view of the manhole cover assembly of FIG. 15.
Figure 21:
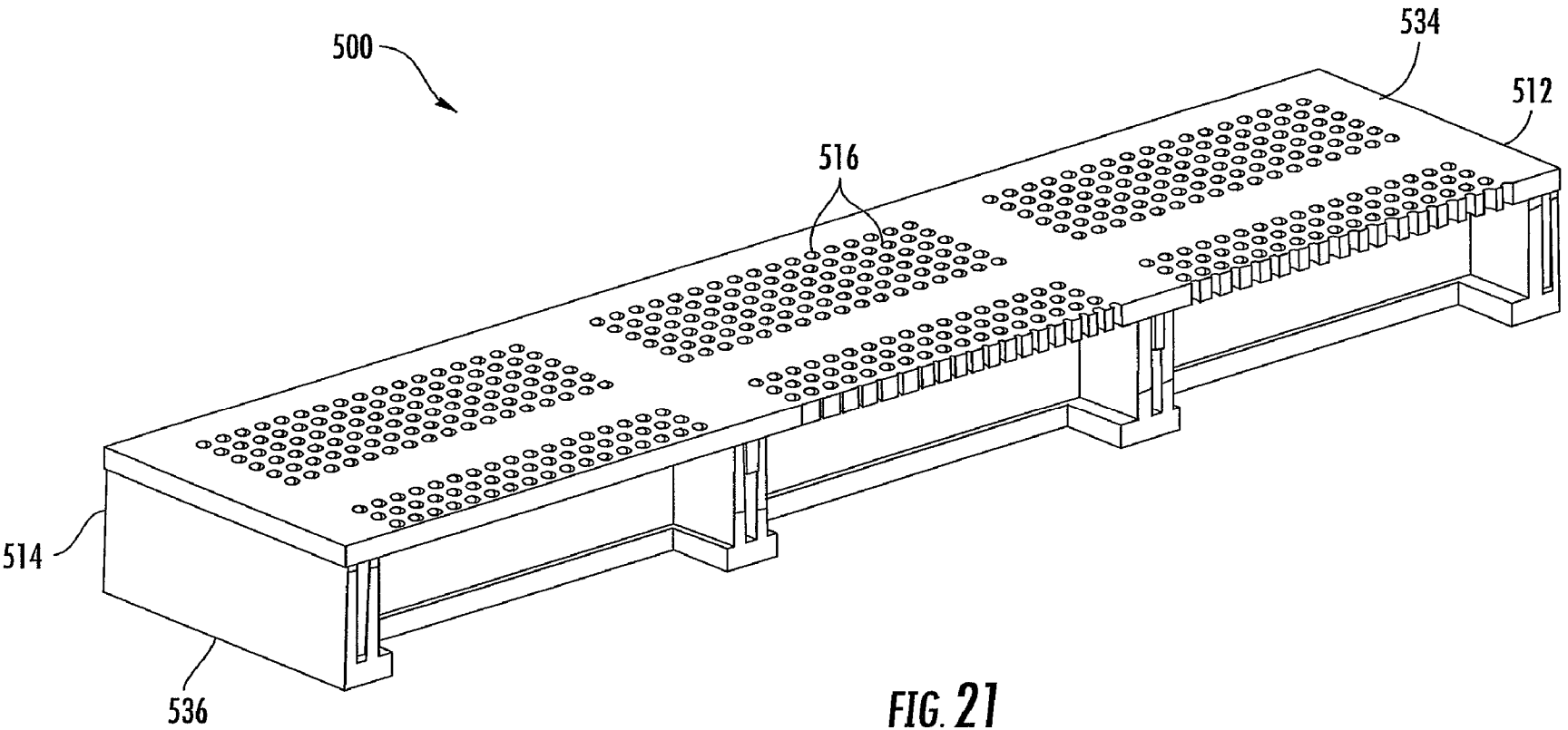
FIG. 21 is a perspective sectional view of the manhole cover assembly of FIG. 15, cut at an angle across the manhole cover assembly.

Once cover 512 and base 514 are aligned, the respective ribs 520, 522 of cover 512 and base 514 may be easily inserted into the respective receptacles 524, 526 (see FIGS. 19 and 21). To maintain a connection between cover 512 and base 514, an adhesive may be provided in or on receptacles 524, 526 or may be applied directly to ribs 520, 522. The adhesive may be a hard system of adhesive adapted to create a firm or fixed connection between cover 512 and base 514, or the adhesive may be a rubberized system of adhesive adapted to allow cover 512 and base 514 to flex or bend, while maintaining a firm connection between cover 512 and base 514. Additionally, or alternatively, ribs 520, 522 may be retained and receptacles 524, 526, respectively, by form-fitting. Once assembled, the ribs and receptacles may create and maintain a distance between cover 512 and base 514 to impart structural strength. Optionally, the distance between cover 512 and base 514 may be in the range of approximately two to ten inches.

Optionally, manhole cover assembly 500 may be ventilated. For example, in the illustrated embodiment, cover 512 includes a plurality of apertures 516 therethrough, which are positioned or arranged at the portions or sections of cover 512 that surround or border the ribs 520 and receptacles 526 of cover 512. Because of the grid-like pattern created by the ribs 520 and receptacles 526 of cover 512, the apertures 516 of cover 512 are divided by the ribs and receptacles into square or rectangular-shaped groups or sections (FIG. 16).

Figure 20:
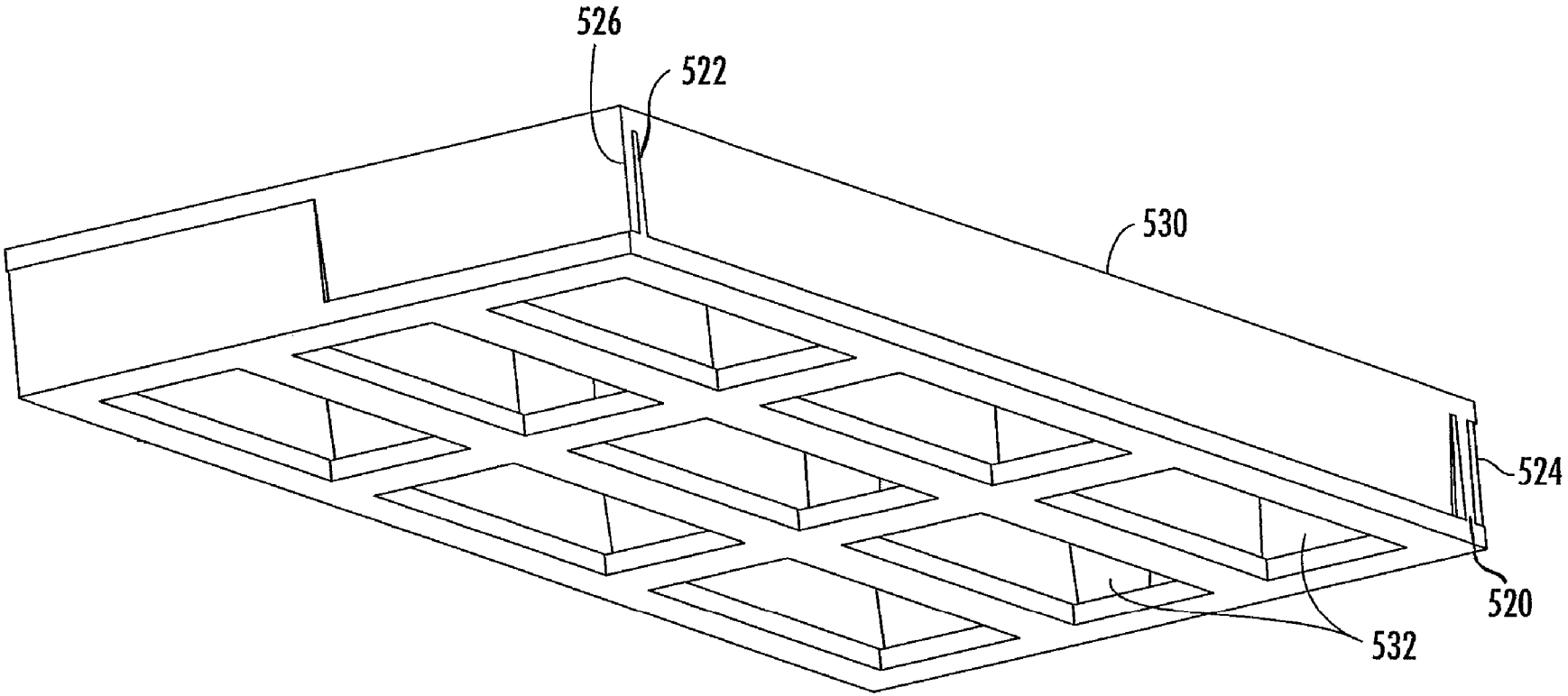
FIG. 20 is a lower perspective view of the manhole cover assembly of FIG. 15.

Base 514 may also include a plurality of apertures therethrough to provide a ventilated manhole cover assembly 500. Optionally, base 514 may include openings or open areas or gaps 532 around or between ribs 522 and receptacles 524 (FIG. 17). Because of the grid-like pattern created by the ribs 522 and receptacles 524 of base 514, the openings 532 of base 514 are formed as square or rectangular-shaped openings. When a base 514 having openings 532 is aligned and connected with cover 512, the cover 512 portion of manhole cover assembly 500 functions to cover a manhole, while base 514 provides increased strength and stiffness to the assembly (see FIGS. 15 and 20). Further, in such a configuration, cover 512 is accessible through the openings 532 in base 514.

Manhole cover assembly 500 may be formed from any suitable material, with cover 512 and base 514 being formed from either the same material or different materials. In the illustrated embodiment, manhole cover assembly 500 is formed from a polymeric material, which one skilled in the art would know may include nylon, urethane, polyester, epoxy, phenolic and the like. Manhole cover assembly 500 may also be formed using any suitable method of manufacture, such as by injection molding, for example. As discussed above, cover 512 and base 514 may be formed using the same injection mold, which may significantly reduce production costs.

In an embodiment in which the same mold is used to produce both the cover and the base of the manhole cover assembly, both cover 512 and base 514 may be formed with the plurality of apertures 516, as discussed above. To achieve the structure of the illustrated embodiment, in which cover 512 includes apertures 516 and base 514 includes openings or gaps 532, at least a portion of base 514 including the plurality of apertures may be removed, such as by milling or machining.

Figure 22:
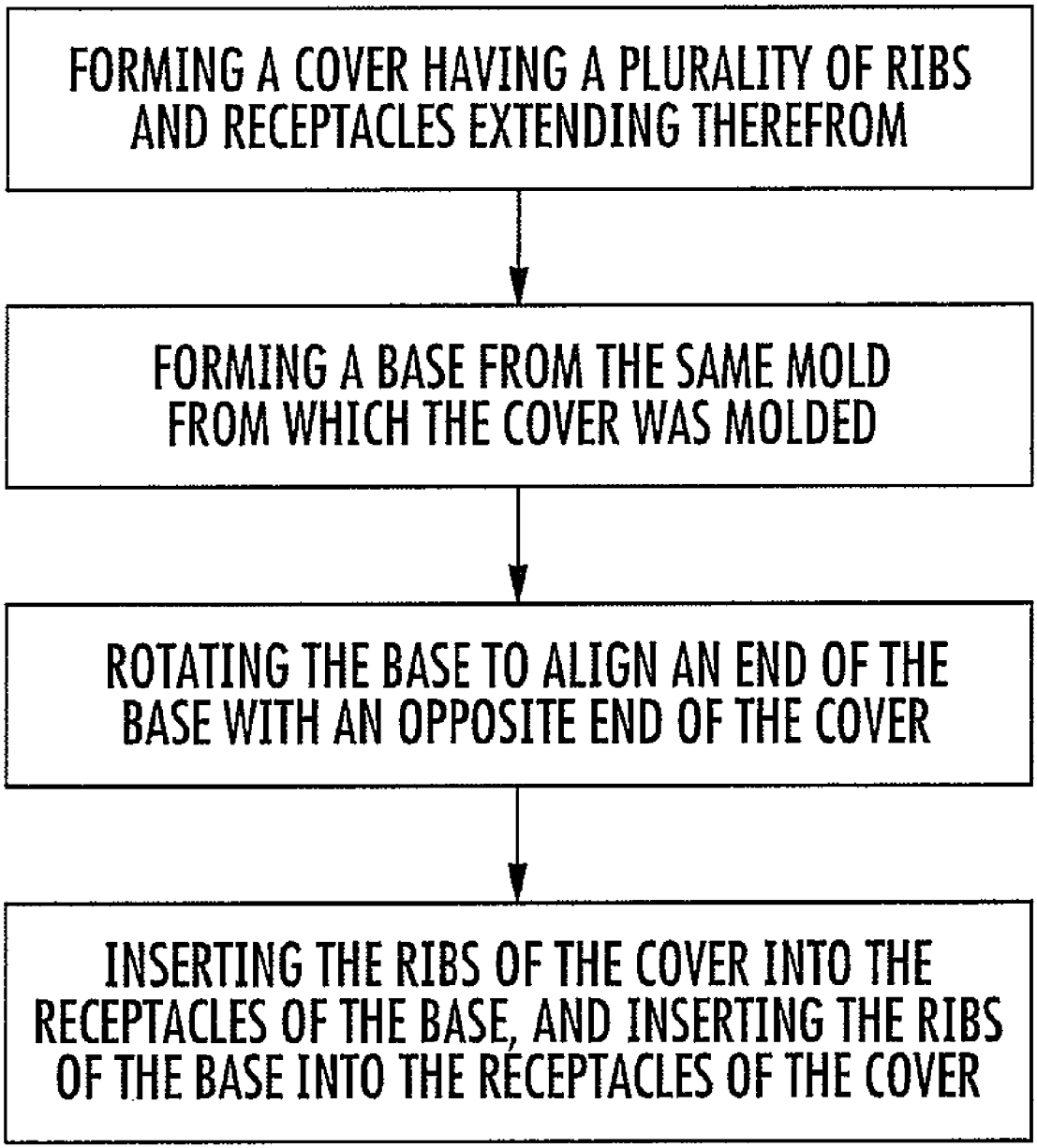
FIG. 22 is a schematic diagram of a method of assembling a manhole cover assembly, according to the present invention.

According to another aspect of the invention, a method of assembling a manhole cover assembly includes providing a cover and a base, with the cover and base each including an inner surface having a plurality of ribs and receptacles extending therefrom (FIG. 22). The cover and the base are molded from a common mold, such that the layout of the ribs and receptacles on the base is generally the same as the layout of the ribs and receptacles on the cover.

The cover and the base are aligned such that the ribs of the cover are adapted to be inserted into the receptacles of the base, and the ribs of the base are adapted to be inserted into the receptacles of the cover. The ribs of the cover are inserted into the receptacles of the base, and the ribs of the base are inserted into the receptacles of the cover.

To facilitate and maintain the connection between the respective ribs and receptacles, an adhesive may be applied between the ribs and the receptacles. Alternately, or additionally, the ribs may be form-fitted into the receptacles.

Further, aligning the cover and the base may include rotating the base and the cover to align an end of the cover with an opposite end of the base. As previously stated, the cover and the base may be molded from a common mold. For example, the cover and the base may be formed or molded from the same injection mold, such that the cover and the base are substantially or generally the same. Accordingly, rotating the cover and the base to align an end of the cover with an opposite end of the base will allow the receptacles of the base to align with the ribs of the cover, and the receptacles of the cover to align with the ribs of the base.

A plurality of apertures may be provided in the cover and the base. For example, the apertures may be positioned about the ribs and the receptacles. At least a portion of the base having the apertures may be machined or milled or otherwise removed to provide at least one opening between the ribs and the receptacles in the base.

Figure 23:
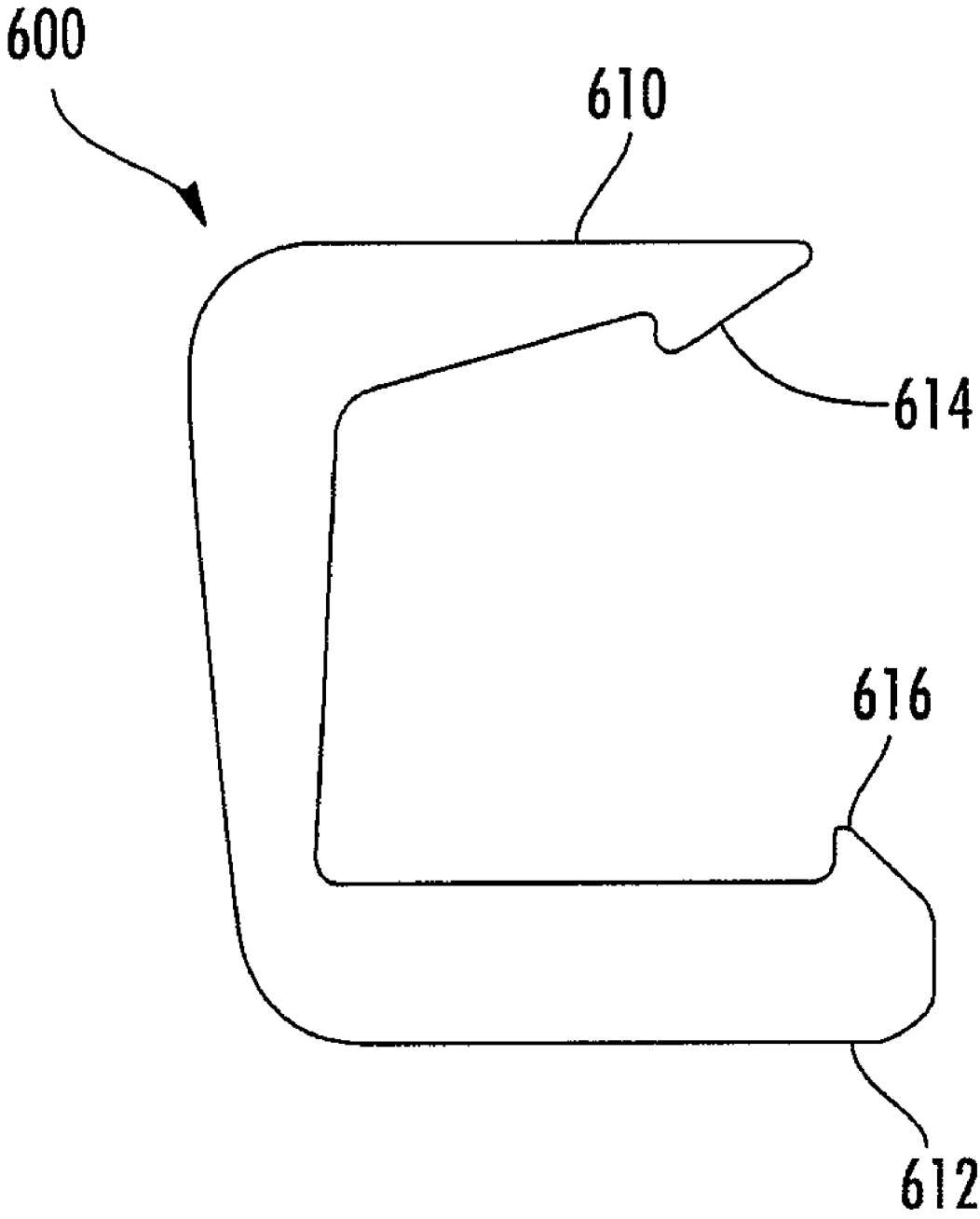
FIG. 23 is a sectional side elevation view of a gasket according to an aspect of the present invention.
Figure 24:
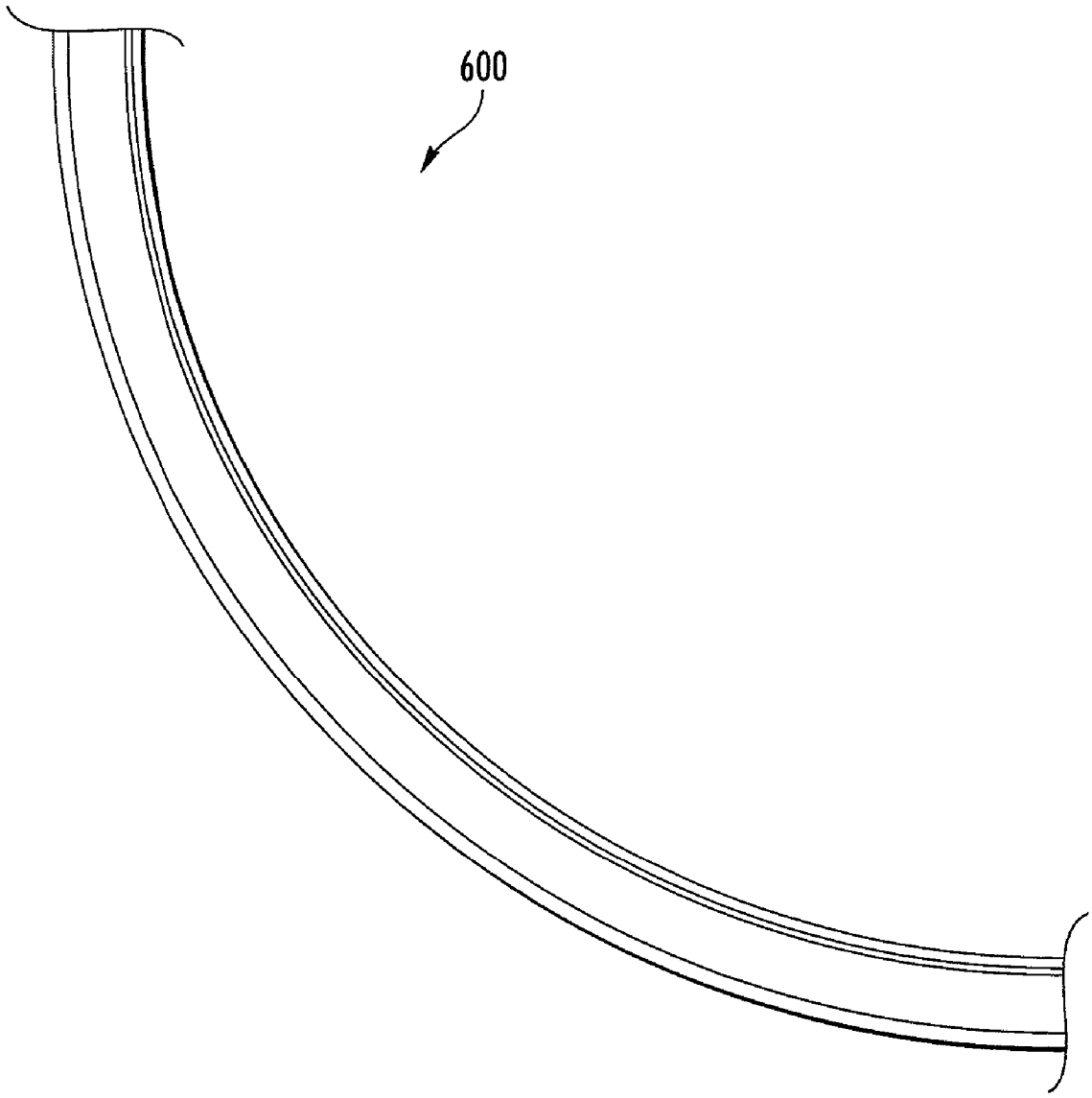
FIG. 24 is a top plan view of the gasket of FIG. 23.

According to another embodiment, a protective gasket 600 may be provided that is formed from an elastomeric material and is adapted to be positioned between a manhole cover or a manhole cover assembly and a manhole or other opening (FIGS. 23 and 24). The manhole or opening generally includes a lip or ledge around its periphery, or a frame that provides such a ledge, at which gasket 600 may be positioned. Alternately, gasket 600 may be adapted to attach or connect to the manhole or manhole cover assembly itself.

Gasket 600 is adapted to protect or seal a variety of manhole covers and assemblies, such as manhole cover assemblies 10, 110, 400 and 500, discussed above. With respect to manhole cover assemblies 10, 110 and 500, which are formed from at least a cover and a base, gasket 600 may also assist in retaining the cover and the base portions of the manhole cover assemblies together. As shown in FIG. 23, gasket 600 includes a generally C-shaped cross section, including two leg portions 610 and 612, and two hook portions 614, 616 positioned at or near an end of leg portions 610 and 612. Using manhole cover assembly 10 as an illustrative example, leg portion 610 may grasp or otherwise attach to cover 12, while leg portion 612 may grasp or otherwise attach to base 14. Hook portions 614, 616 may assist in grasping or attaching gasket 600 to the cover and base, respectively. Thus, gasket 600 functions to assist in retaining cover 12 and base 14 together. Further, gasket 600 may create a sealed connection between manhole cover assembly 10 and an opening.

Gasket 600 is formed from an elastomeric material, which is generally abrasion-resistant, shock-absorbent and impact-resistant. Gasket 600 is adapted to cover or enclose the periphery of the manhole cover assembly and, therefore, protects the edge at which cover 12 and base 14 are joined or bonded. Thus, gasket 600 may prevent cover 12 and base 14 from being dislodged from each other, such as in the case of rolling the manhole cover assembly on its edge or the like. Optionally, the elastomeric material of gasket 600 may comprise an EPDM elastomer, which may be purchased from International Track Systems, Inc., having a place of business at 3009 Wilmington Road, Suite C, New Castle, Pa., 16105.

Figure 25:
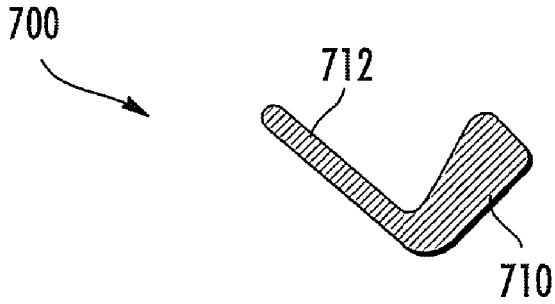
FIG. 25 sectional side elevation of another gasket according to the present invention.
Figure 26:
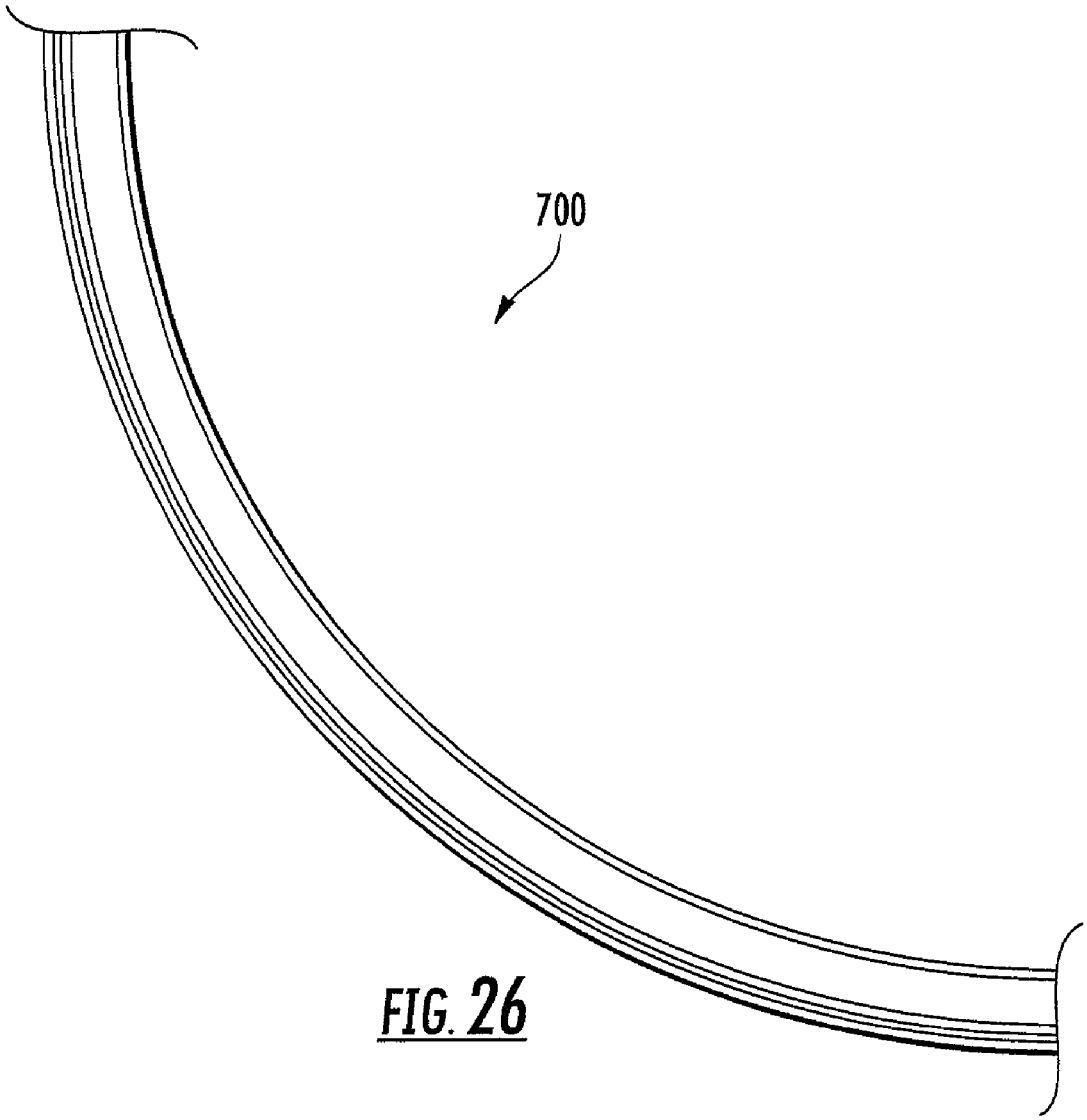
FIG. 26 is a top plan view of the gasket of FIG. 25.
Figure 27:
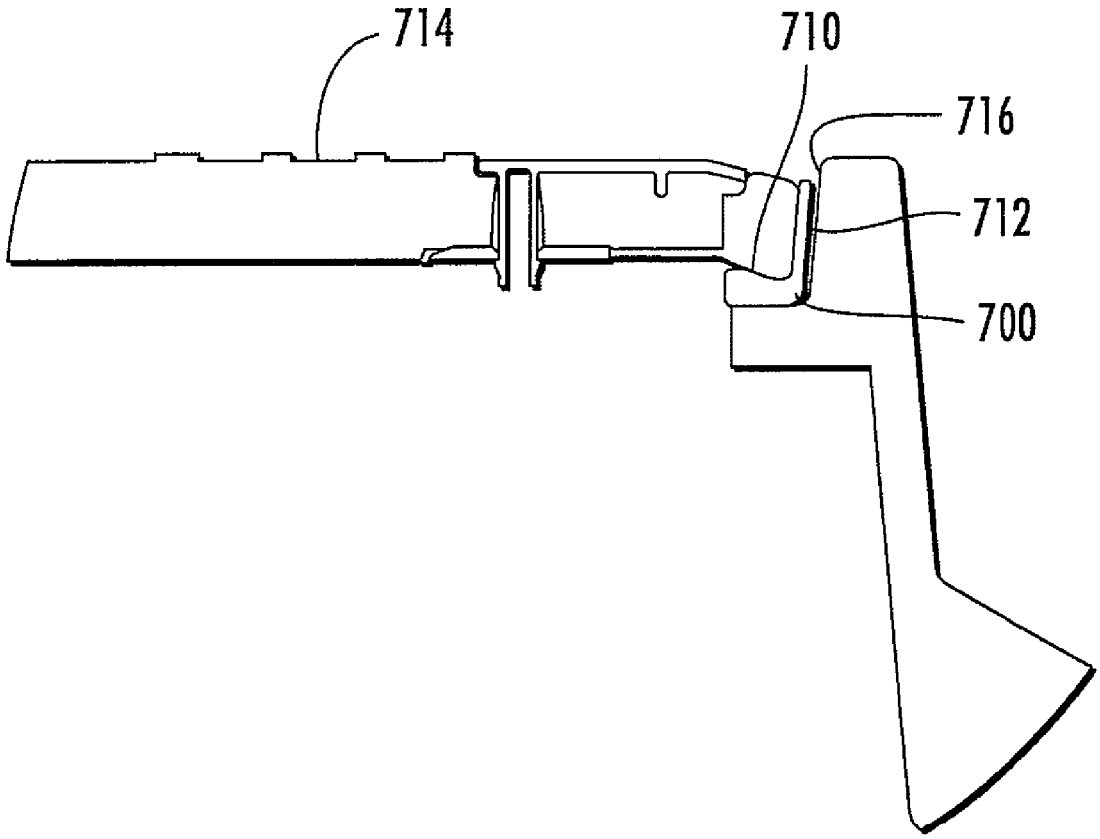
FIG. 27 is a sectional side elevation of the gasket of FIGS. 25 and 26, positioned between a manhole cover and an opening.

Alternatively, a protective gasket 700 may be provided having a generally L-shaped cross section, including two legs 710 and 712 (FIGS. 25 and 26). For example, as best shown in FIG. 27, leg 712 is adapted to be positioned between an outer edge of a manhole cover 714 and opening 716, while leg 710 is adapted to be positioned between a bottom edge of manhole cover 714 and opening 716 or a lip portion thereof. Thus, manhole cover 714 may be positioned to engage gasket 700, as opposed to directly engaging a portion of opening 716. As discussed above with respect to gasket 600, the elastomeric material of gasket 700 is generally abrasion-resistant, shock-absorbent and impact-resistant, such that use of gasket 700 may prevent damage to the manhole cover or manhole cover assembly, for example, to manhole cover 714.

Thus, the various embodiments of the present invention provide a low-cost and lightweight manhole cover and assembly. The lightweight polymeric or reinforced composite material allows the manhole cover assembly to be easily moved and/or transported and may prevent injuries which have occurred with respect to heavy steel manhole covers presently known in the art. Further, use of polymeric or reinforced composite material results in lower tooling costs, and faster production cycles as opposed to using a steel or the like. Moreover, manhole cover assemblies according to the present invention are transparent to radio frequency signals, which allow wireless meter reading. Also, a gasket is provided to seal the manhole cover assembly at the opening which it is covering to prevent water or other matter from protruding through the opening. Further, when covering a sewer, a sealed manhole cover may prevent water or other matter from entering the sewer and combining with sewage, thus reducing the total amount of sewage to treat. A sealed manhole cover may also keep dust and debris and moisture from fiberoptic areas.

Additionally, the embodiments of the manhole cover assembly have demonstrated extremely high break strengths. For example, ultimate break strength testing has shown a two-piece composite cover assembly to have an ultimate break strength of 110,000 pounds. Further, fatigue testing was performed on the same two-piece composite cover assembly for 70,000 cycles. These test results prove the two-piece composite cover assembly to be in compliance with European standard EN12.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A manhole cover assembly, comprising:

a cover having a first inner surface; and a base adapted for connecting to said cover, said base having a second inner surface;

a plurality of receptacles extending from one of said first and second inner surfaces and a plurality of ribs extending from the other of said first and second inner surfaces, wherein said plurality of receptacles have a layout that generally corresponds to a layout of said plurality of ribs, wherein said ribs and said receptacles are configured to insert said ribs in said receptacles and to retain said ribs in said receptacles to assist in retaining said base and said cover together and to impart structural strength and stiffness to said assembly.

2. The manhole cover assembly of claim 1, wherein said plurality of ribs and said plurality of receptacles space said cover from said base.

3. The manhole cover assembly of claim 2, wherein a periphery of said cover abuts a periphery of said base.

4. The manhole cover assembly of claim 1, including an adhesive adhering said plurality of ribs and said plurality of receptacles together to retain said ribs in said receptacles.

5. The manhole cover assembly of claim 1, wherein said ribs are form-fitted with said receptacles to retain said ribs in said receptacles.

6. The manhole cover assembly of claim 1, wherein said ribs extending from said first inner surface of said cover and said receptacles extending from said second inner surface of said base.

7. The manhole cover assembly of claim 1, wherein said cover and said base are formed from a polymeric material.

8. The manhole cover assembly of claim 1, wherein said cover and said base have corresponding positioning members to align said cover and said base.

9. The manhole cover assembly of claim 1, wherein said receptacles extending from said first inner surface of said cover and said plurality of ribs extending from said second inner surface of said base.

10. The manhole cover assembly of claim 1, wherein a portion of said ribs and said receptacles are extending from said first inner surface of said base and wherein another portion of said ribs and said receptacles are extending from said first inner surface of said cover, wherein said portion of said ribs and said receptacles have generally the same layout as said another portion of said ribs and said receptacles, whereby said cover and said base may be formed from a common mold configuration.

11. A manhole cover assembly, comprising:

a cover having a first inner surface, said cover further having a first plurality of ribs and a first plurality of receptacles extending from said first inner surface of said cover;

a base adapted for connecting to said cover, said base having a second inner surface, said base further having a second plurality of ribs and a second plurality of receptacles extending from said second inner surface of said base, wherein a layout of said second plurality of ribs and said second plurality of receptacles on said base is generally the same as a layout of said first plurality of ribs and said first plurality of receptacles on said cover; and wherein with said second inner surface of said base aligned to face said first inner surface of said cover, said first plurality of ribs and said second plurality of receptacles are configured to insert said first plurality of ribs in said second plurality receptacles and to retain said first plurality of ribs in said second plurality of receptacles, wherein said second plurality of ribs and said first plurality of receptacles are configured to insert said second plurality of ribs in said first plurality of receptacles and to retain said second plurality of ribs in said first plurality of receptacles to assist in retaining said base and said cover together and to impart structural strength and stiffness to said assembly.

12. The manhole cover assembly of claim 11, wherein each of said rows includes at least one of said first and second plurality of ribs and at least one of said first and second plurality of receptacles.

13. The manhole cover assembly of claim 11, wherein said cover and said base are generally rectangular in shape.

14. The manhole cover assembly of claim 11, wherein said cover has a plurality of apertures therethrough, said apertures being arranged between said first ribs and said first plurality of receptacles.

15. The manhole cover assembly of claim 11, wherein at least a portion of said base is removed between said second plurality of ribs and said second plurality of receptacles to create at least one opening in said base.

16. The manhole cover assembly of claim 11 including an adhesive adhering said ribs and said receptacles to retain said ribs in said receptacles.

17. The manhole cover assembly of claim 11 wherein said ribs are form-fitted with said receptacles to retain said ribs in said receptacles.

18. The manhole cover assembly of claim 11, wherein said layout of said first plurality of ribs and said first plurality of receptacles of said cover and said layout of said second plurality of ribs and said second plurality of receptacles of said base comprise at least two parallel rows and at least two parallel columns on said cover and said base, said rows being generally perpendicular to said columns.

19. The manhole cover assembly of claim 18, wherein each of said columns includes at least one of said first and second plurality of ribs and at least one of said first and second plurality of receptacles.

20. The manhole cover assembly of claim 11, wherein said cover and said base are formed from a polymeric material.

21. The manhole cover assembly of claim 20, wherein said cover and said base are manufactured by injection molding and formed from a common mold configuration.

22. A method of assembling a manhole cover assembly, comprising:

providing a cover and a base, said cover having a first inner surface, said cover further having a first plurality of ribs and a first plurality of receptacles extending from said first inner surface of said cover, and said base having an inner surface, said base further having a second plurality of ribs and a second plurality of receptacles extending from a second said inner surface of said base, wherein a layout of said second plurality of ribs and receptacles on said base is generally the same as a layout of said first plurality of ribs and the first plurality of receptacles on said cover;

molding said cover and said base from a common mold design;

aligning said cover and said base such that said first plurality of ribs of said cover are adapted to be inserted into said second plurality of receptacles of said base, and wherein said second plurality of ribs of said base are adapted to be inserted into said first plurality of receptacles of said cover; and inserting said first plurality of ribs of said cover into said second plurality of receptacles of said base and inserting said second plurality of ribs of said base into said first plurality of receptacles of said cover to retain said ribs in said receptacles and thereby assisting in retaining said base and said cover together and to impart structural strength and stiffness to said assembly.

23. The method of claim 22, wherein aligning said cover and said base further comprises rotating said base and said cover to align a portion of said cover with an opposite portion of said base.

24. The method of claim 22, including providing a plurality of apertures in said cover and said base, said apertures positioned between said ribs and said receptacles.

25. The method of claim 22, including machining at least a portion of said base to provide at least one opening between said second plurality of ribs and said second plurality of receptacles in said base.

26. the method of claim 22 including applying an adhesive to said ribs and said receptacles, thereby retaining said ribs in said receptacles.

27. The method of claim 22 wherein said ribs are form-fitted with said receptacles, thereby retaining said ribs in said receptacles.

28. A manhole cover assembly, comprising:

a cover and a base connected with said cover at least at a periphery of said base and said cover to form a manhole cover;

a gasket adapted to be positioned between said manhole cover and an opening covered by said manhole cover, and wherein said gasket is formed from elastomeric material to resist abrasion between said manhole cover and the opening covered by said manhole cover;

wherein said gasket is adapted to assist in retaining said cover and said base together by covering said periphery of said manhole cover and wherein said gasket is adapted to seal between said manhole cover and the opening covered by said manhole cover.

29. The gasket of claim 28, wherein a cross section of said seal is one chosen from generally C-shaped and generally L-shaped.

* * * * *